US011393418B2

(12) United States Patent
Duan et al.

(10) Patent No.: US 11,393,418 B2
(45) Date of Patent: Jul. 19, 2022

(54) METHOD, DEVICE AND SYSTEM FOR DATA TRANSMISSION, AND DISPLAY DEVICE

(71) Applicants: Beijing BOE Display Technology Co., Ltd., Beijing (CN); BOE Technology Group Co., Ltd., Beijing (CN)

(72) Inventors: Xin Duan, Beijing (CN); Hsinchung Lo, Beijing (CN); Ming Chen, Beijing (CN); Xibin Shao, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 374 days.

(21) Appl. No.: 16/487,484

(22) PCT Filed: Oct. 19, 2018

(86) PCT No.: PCT/CN2018/111104

§ 371 (c)(1),
(2) Date: Aug. 21, 2019

(87) PCT Pub. No.: WO2019/165786

PCT Pub. Date: Sep. 6, 2019

(65) Prior Publication Data

US 2021/0335291 A1 Oct. 28, 2021

(30) Foreign Application Priority Data

Mar. 1, 2018 (CN) ..... 201810172079.4

(51) Int. Cl.

| | |
|---|---|
| ***G09G 3/20*** | (2006.01) |
| ***G09G 5/00*** | (2006.01) |
| ***G09G 3/36*** | (2006.01) |

(52) U.S. Cl.
CPC ..... *G09G 3/36* (2013.01); *G09G 2310/0286* (2013.01); *G09G 2320/0693* (2013.01); *G09G 2370/045* (2013.01); *G09G 2370/08* (2013.01)

(58) Field of Classification Search
CPC .. G09G 3/00; G09G 3/20; G09G 3/36; G09G 3/3208; G09G 3/3275; G09G 5/00;
(Continued)

(56) References Cited

U.S. PATENT DOCUMENTS

| | | | |
|---|---|---|---|
| 2010/0045588 | A1 | 2/2010 | Lee et al. |
| 2012/0242628 | A1 | 9/2012 | Yuan et al. |

(Continued)

FOREIGN PATENT DOCUMENTS

| | | | |
|---|---|---|---|
| CN | 101656057 | A | 2/2010 |
| CN | 102955679 | A | 3/2013 |

(Continued)

OTHER PUBLICATIONS

International search report and written opinion of PCT application No. PCT/CN2018/111104 dated Jan. 25, 2019.

(Continued)

*Primary Examiner* — Chanh D Nguyen
*Assistant Examiner* — Nguyen H Truong
(74) *Attorney, Agent, or Firm* — Fay Sharpe LLP

(57) ABSTRACT

The present application discloses a method, device and system for data transmission, and a display device, and belongs to the field of manufacturing of a liquid crystal panel. The method is applied to a controller. The controller is connected to a plurality of driver chips connected in parallel via a first signal line, and the plurality of driver chips is sequenced according to a response feedback sequence. The method comprises: generating a data request instruction; sending, via the first signal line, a data request instruction; receiving, via the first signal line, the data response (Continued)

instructions sequentially sent by the plurality of driver chips according to the response feedback sequence, wherein each of the data response instructions comprises an identity of a corresponding driver chip and data of the corresponding driver chip. The present application may enrich the function of the first signal line and improve the utilization rate.

19 Claims, 15 Drawing Sheets

(58) Field of Classification Search
CPC .. G09G 5/02; G09G 5/12; G09G 5/18; G09G 2310/0286; G09G 2320/0693; G09G 2370/045; G09G 2370/08; G06F 3/038
See application file for complete search history.

(56) References Cited

U.S. PATENT DOCUMENTS

2014/0118235 A1* 5/2014 Hong ..... G09G 5/008 345/87
2016/0125840 A1* 5/2016 Oh ..... G09G 5/008 345/213
2016/0189595 A1 6/2016 Choi et al.
2017/0053598 A1* 2/2017 Kwon ..... G09G 3/3233
2017/0069257 A1* 3/2017 Lee ..... G09G 5/005
2017/0132966 A1* 5/2017 Lim ..... G09G 5/18
2018/0122294 A1* 5/2018 Do ..... G09G 5/008

FOREIGN PATENT DOCUMENTS

CN 105741728 A 7/2016
CN 106469537 A 3/2017
KR 20080003193 A 1/2008

OTHER PUBLICATIONS

Extended European search report of counterpart EP application No. 18904495.1 dated Nov. 26, 2021.

* cited by examiner

METHOD, DEVICE AND SYSTEM FOR DATA TRANSMISSION, AND DISPLAY DEVICE

CROSS-REFERENCE TO RELATED APPLICATION

This application is a 371 of PCT Patent Application Serial No. PCT/CN2018/111104, filed on Oct. 19, 2018, which claims priority to Chinese Patent Application No. 201810172079.4, filed with the National Intellectual Property Administration of P.R.C. on Mar. 1, 2018 and entitled "METHOD, COMPONENT AND SYSTEM FOR DATA TRANSMISSION, AND DISPLAY DEVICE", the entire contents of which are incorporated herein by reference.

TECHNICAL FIELD

The present application relates to a method, device and system for date transmission and a display device.

BACKGROUND

The display device may generally include a display panel and a panel driving circuit for driving the display panel. The panel driving circuit may include a timing controller (T/CON), a gate driving circuit, and a source driving circuit. The gate driving circuit includes a plurality of gate driver chips, and the source driving circuit includes a plurality of source driver chips. The panel driving circuit generally includes two types of signal lines, and the two types of signal lines include: low-speed signal line and a high-speed signal line. The signal transmission rate of the low-speed signal line is less than the signal transmission rate of the high-speed signal line. The low-speed signal line is typically used to identify a level state. The high-speed signal line is used to transmit a high-speed differential signal.

In the driving process of the panel, a point-to-point high-speed signal transmission technology is generally used for signal transmission. It is characterized by establishing one-to-one high-speed signal lines between two chips of the panel driving circuit (for example, the two chips may be the timing controller and a source driver chip), to transmit the high-speed differential signal. The timing controller is further provided with an additional low-speed signal line. The plurality of source driver chips is connected in parallel and is connected to the low-speed signal line. Such low-speed signal line is used to cooperate with the high-speed signal lines to perform clock synchronization between the timing controller and the source driver chips.

SUMMARY

Embodiments of the present application provide a method, device and system for date transmission and a display device. The technical solutions are as follows.

According to a first aspect, there is provided a data transmission method. The method is applied to a controller, wherein the controller is connected to a plurality of driver chips connected in parallel via a first signal line, the plurality of driver chips is sequenced according to a response feedback sequence, and the method comprises:

generating a data request instruction;

sending, via the first signal line, the data request instruction to the plurality of driver chips; and receiving, via the first signal line, data response instructions sequentially sent by the plurality of driver chips according to the response feedback sequence, wherein each of the data response instructions comprises an identity of a corresponding driver chip and data of the corresponding driver chip.

Optionally, the data request instruction comprises an identity of a start driver chip, the start driver chip is a driver chip of the plurality of driver chips, and receiving, via the first signal line, data response instructions sequentially sent by the plurality of driver chips according to the response feedback sequence comprises:

receiving, via the first signal line, data response instructions sequentially sent by the plurality of driver chips from the start driver chip according to the response feedback sequence.

Optionally, each of instructions transmitted on the first signal line comprises a preamble, a start identification, data bits and a stop identification which are arranged in sequence;

wherein the preamble is used to instruct a recipient device to perform clock calibration and phase calibration, the start identification is used to indicate a start of data transmission, the data bits are used to carry target data, and the stop identification is used to indicate a stop of data transmission.

Optionally, the instructions transmitted via the first signal line comprises a data request instruction and a data response instruction.

Optionally, the target data carried by the data bits of the data request instruction comprises: a transmission mode of the first signal line, an identity of a start driver chip, a register address configured on the plurality of driver chips, and a data checksum; and the target data carried by the data bits of each of the data response instructions comprises: a transmission mode of the first signal line, an identity of the corresponding driver chip, a register address configured on the plurality of driver chips, data of the corresponding driver chip, and a data checksum.

Optionally, time intervals between two adjacent instructions transmitted on the first signal line are equal to a preset duration.

Optionally, the start driver chip is different from a last driver chip of the plurality of driver chips, and receiving, via the first signal line, the data response instructions sequentially sent by the plurality of driver chips from the start driver chip according to the response feedback sequence comprises:

receiving, via the first signal line, the data response instructions sequentially sent by the plurality of driver chips from the start driver chip to the last driver chip according to the response feedback sequence.

Optionally, the data request instruction further comprises an identity of a termination driver chip, wherein the termination driver chip is a driver chip behind the start driver chip in the plurality of driver chips, receiving, via the first signal line, the data response instructions sequentially sent by the plurality of driver chips from the start driver chip according to the response feedback sequence comprises:

receiving, via the first signal line, the data response instructions sequentially sent by the plurality of driver chips from the start driver chip to the termination driver chip according to the response feedback sequence.

Optionally, the start driver chip is a first driver chip of the plurality of driver chips which are arranged according to the response feedback sequence.

Optionally, the identities of the plurality of driver chips are characters having sequential features, and the response feedback sequence is a sequence obtained by sequencing according to the sequential features of the identities.

Optionally, the identities of the plurality of driver chips are different numbers, and the response feedback sequence is a sequence in which the identities are arranged from small to large.

Optionally, the preamble is obtained by Manchester encoding of continuous at least 8 bits of binary 0;

the start identification comprises continuous at least 2 bits of binary 0;

the target data carried by the data bits is data obtained by Manchester encoding; and the stop identification comprises continuous at least 2 bits of binary 1.

Optionally, the method further comprises:

in a process of signal transmission via the first signal line, performing clock calibration operation when detecting that a signal on the first signal line is pulled low.

According to a second aspect, there is provided a data transmission method, applied to a first driver chip, wherein the first driver chip is any one of a plurality of driver chips, the plurality of driver chips is connected in parallel and is connected to a controller via a first signal line, the plurality of driver chips is sequenced according to a response feedback sequence, and the method comprises:

receiving a data request instruction sent by the controller via the first signal line;

when the first driver chip is a start driver chip, sending, via the first signal line, a first data response instruction to the controller and remaining driver chips, wherein the first data response instruction comprises an identity of the first driver chip and data of the first driver chip;

wherein, the first data response instruction is used to trigger driver chips behind the first driver chip in the plurality of driver chips to sequentially send data response instructions according to the response feedback sequence, wherein each of the data response instructions comprises an identity of a corresponding driver chip and data of the corresponding driver chip.

Optionally, the data request instruction comprises an identity of the start driver chip, and after receiving the data request instruction sent by the controller via the first signal line, the method further comprises:

determining whether the first driver chip is the start driver chip according to the identity of the start driver chip and identity of the first driver chip.

Optionally, each of instructions transmitted on the first signal line comprises a preamble, a start identification, data bits and a stop identification which are arranged in sequence;

wherein the preamble is used to instruct a recipient device to perform clock calibration and phase calibration, the start identification is used to indicate a start of data transmission, the data bits are used to carry target data, and the stop identification is used to indicate a stop of data transmission.

Optionally, the instructions transmitted via the first signal line comprises a data request instruction and a data response instruction.

Optionally, the target data carried by the data bits of the data request instruction comprises: a transmission mode of the first signal line, an identity of the start driver chip, a register address configured on the plurality of driver chips, and a data checksum; and the target data carried by the data bits of each of the data response instructions comprises: a transmission mode of the first signal line, an identity of the corresponding driver chip, a register address configured on the plurality of driver chips, data of the corresponding driver chip, and a data checksum.

Optionally, time intervals between two adjacent instructions transmitted on the first signal line are equal to a preset duration.

Optionally, the start driver chip is different from a last driver chip of the plurality of driver chips, and the method further comprises:

when the first driver chip is not the start driver chip, receiving a second data response instruction sent by another driver chip via the first signal line;

when the identity of a driver chip carried in the second data response instruction is the identity of the previous driver chip of the first driver chip, sending a third data response instruction to the controller and remaining driver chips via the first signal line, wherein the third data response instruction comprises the identity of the first driver chip and the data of the first driver chip;

wherein the third data response instruction is used to trigger driver chips behind the first driver chip in the plurality of driver chips to sequentially send data response instructions according to the response feedback sequence.

Optionally, the data request instruction comprises an identity of a termination driver chip, wherein the termination driver chip is the driver chip behind the start driver chip in the plurality of driver chips, and the method further comprises:

when the identity of the start driver chip is not the identity of the first driver chip, recording the identity of the termination driver chip;

receiving a second data response instruction sent by another driver chip via the first signal line; and when the identity carried in the second data response instruction is the identity of the previous driver chip of the first driver chip, and the identity of the previous driver chip is the identity of the termination driver chip, stopping action, Optionally, the start driver chip is a first driver chip of the plurality of driver chips which are arranged according to the response feedback sequence.

Optionally, the identities of the plurality of driver chips are characters having sequential features, and the response feedback sequence is a sequence obtained by sequencing according to the sequential features of the identities.

Optionally, the identities of the plurality of driver chips are different numbers, and the response feedback sequence is a sequence in which the identities are arranged from small to large.

Optionally, the preamble is obtained by Manchester encoding of continuous at least 8 bits of binary 0;

the start identification comprises continuous at least 2 bits of binary 0;

the target data carried by the data bits is data obtained by Manchester encoding; and the stop identification comprises continuous at least 2 bits of binary 1.

Optionally, the method further comprises:

in a process of signal transmission via the first signal line, when the first driver chip has an abnormality, pulling a signal on the first signal line low, such that the controller performs clock calibration operation according to the pulled-low signal.

According to a third aspect, there is provided a data transmission system, comprising a timing controller and a plurality of source driver chips connected in parallel, wherein the timing controller is connected to the plurality of source driver chips connected in parallel via a first signal line, the plurality of source driver chips is sequenced according to a response feedback sequence, the plurality of source driver chips comprises a start source driver chip, and the start source driver chip is different from a last source driver chip of the plurality of source driver chips;

the timing controller is used to generate a data request instruction and send the data request instruction via the first signal line;

the start source driver chip is used to send a first data response instruction to the timing controller and remaining source driver chips via the first signal line when the data request instruction is received, wherein the first data response instruction comprises an the identity of the start source driver chip and data of the start source driver chip; and each of source driver chips behind the start source driver chip is used to receive a second data response instruction sent by another source driver chip via the first signal line; and when an identity carried in the second data response instruction is an identity of a previous source driver chip of the source driver chip, a third data response instruction is sent via the first signal line to the timing controller and remaining source driver chips, wherein the third data response instruction comprises an identity of the source driver chip and data of the source driver chip.

Optionally, the start source driver chip is a first source driver chip of the plurality of source driver chips which are arranged according to the response feedback sequence.

According to a fourth aspect, there is provided a data transmission device, applied to a controller, wherein the controller is connected to a plurality of driver chips connected in parallel via a first signal line, the plurality of driver chips is sequenced according to a response feedback sequence, and the data transmission device comprises:

one or more processors; and a memory;

the memory stores one or more programs, wherein the one or more programs are used to be executed by the one or more processors, and the one or more programs comprise instructions for performing the following operations:

generating a data request instruction;

sending, via the first signal line, the data request instruction to the plurality of driver chips; and receiving, via the first signal line, data response instructions sequentially sent by the plurality of driver chips according to the response feedback sequence, wherein each of the data response instructions comprises an identity of a corresponding driver chip and data of the corresponding driver chip.

Optionally, the data request instruction comprises an identity of a start driver chip, and the one or more programs further comprise an instruction for performing the following operation.

receiving, via the first signal line, data response instructions sequentially sent by the plurality of driver chips from the start driver chip according to the response feedback sequence.

Optionally, each of instructions transmitted on the first signal line comprises a preamble, a start identification, data bits and a stop identification which are arranged in sequence;

wherein the preamble is used to instruct a recipient device to perform clock calibration and phase calibration, the start identification is used to indicate a start of data transmission, the data bits are used to carry target data, and the stop identification is used to indicate a stop of data transmission.

Optionally, the target data carried by the data bits of the data request instruction comprises: a transmission mode of the first signal line, an identity of a start driver chip, a register address configured on the plurality of driver chips, and a data checksum; and the target data carried by the data bits of each of the data response instructions comprises: a transmission mode of the first signal line, an identity of the corresponding driver chip, a register address configured on the plurality of driver chips, data of the corresponding driver chip, and a data checksum.

Optionally, time intervals between two adjacent instructions transmitted on the first signal line are equal to a preset duration.

Optionally, the start driver chip is different from a last driver chip of the plurality of driver chips, and the one or more programs comprise an instruction for performing the following operation:

receiving, via the first signal line, the data response instructions sequentially sent by the plurality of driver chips from the start driver chip to the last driver chip according to the response feedback sequence.

Optionally, the data request instruction further comprises an identity of a termination driver chip, wherein the termination driver chip is a driver chip behind the start driver chip in the plurality of driver chips, and the one or more programs further comprise an instruction for performing the following operation:

receiving, via the first signal line, the data response instructions sequentially sent by the plurality of driver chips from the start driver chip to the termination driver chip according to the response feedback sequence.

Optionally, the start driver chip is a first driver chip of the plurality of driver chips which are arranged according to the response feedback sequence.

Optionally, the identities of the plurality of driver chips are characters having sequential features, and the response feedback sequence is a sequence obtained by sequencing according to the sequential features of the identities.

Optionally, the identities of the plurality of driver chips are different numbers, and the response feedback sequence is a sequence in which the identities are arranged from small to large.

Optionally, the preamble is obtained by Manchester encoding of continuous at least 8 bits of binary 0;

the start identification comprises continuous at least 2 bits of binary 0;

the target data carried by the data bits is data obtained by Manchester encoding; and the stop identification comprises continuous at least 2 bits of binary 1.

Optionally, the one or more programs further comprise an instruction for performing the following operation:

in a process of signal transmission via the first signal line, performing clock calibration operation when detecting that a signal on the first signal line is pulled low.

According to a fifth aspect, there is provided a data transmission device, applied to a first driver chip, wherein the first driver chip is any one of a plurality of driver chips, the plurality of driver chips is connected in parallel and is connected to a controller via a first signal line, the plurality of driver chips is sequenced according to a response feedback sequence, and the data transmission device comprises:

one or more processors; and a memory;

the memory stores one or more programs, the one or more programs are used to be executed by the one or more processors, and the one or more programs comprise instructions for performing the following operations:

receiving a data request instruction sent by the controller the first signal line;

when the first driver chip is a start driver chip, sending, via the first signal line, a first data response instruction to the controller and remaining driver chips, wherein the first data response instruction comprises an identity of the first driver chip and data of the first driver chip;

wherein, the first data response instruction is used to trigger driver chips behind the first driver chip in the plurality of driver chips to sequentially send the data response instructions according to the response feedback sequence, and wherein each of the data response instructions comprises the an identity of the a corresponding driver chip and the data of the corresponding driver chip.

Optionally, each of the instructions transmitted on the first signal line comprises a preamble, a start identification, data bits and a stop identification which are arranged in sequence;

wherein the preamble is used to instruct a recipient device to perform clock calibration and phase calibration, the start identification is used to indicate a start of data transmission, the data bits are used to carry target data, and the stop identification is used to indicate a stop of data transmission.

Optionally, the target data carried by the data bits of the data request instruction comprises: a transmission mode of the first signal line, an identity of the start driver chip, a register address configured on the plurality of driver chips, and a data checksum; and the target data carried by the data bits of each of the data response instructions comprises: a transmission mode of the first signal line, an identity of the corresponding driver chip, a register address configured on the plurality of driver chips, data of the corresponding driver chip, and a data checksum.

Optionally, time intervals between two adjacent instructions transmitted on the first signal line are equal to a preset duration.

Optionally, the start driver chip is different from a last driver chip of the plurality of driver chips, and the one or more programs further comprise instructions for performing the following operations:

when the first driver chip is not the start driver chip, receiving a second data response instruction sent by another driver chip via the first signal line;

when the identity of a driver chip carried in the second data response instruction is the identity of a previous driver chip of the first driver chip, sending a third data response instruction to the controller and the remaining driver chips via the first signal line, wherein the third data response instruction comprises the identity of the first driver chip and the data of the first driver chip;

wherein the third data response instruction is used to trigger driver chips behind the first driver chip in the plurality of driver chips to sequentially send the data response instructions according to the response feedback sequence.

Optionally, the data request instruction further comprises the identity of a termination driver chip, wherein the termination driver chip is the driver chip located behind the start driver chip in the plurality of driver chips, and the one or more programs further comprise instructions for performing the following operations:

when an identity of the start driver chip is not the identity of the first driver chip, recording the identity of the termination driver chip;

receiving a second data response instruction sent by another driver chip via the first signal line; and when an identity carried in the second data response instruction is an identity of a previous driver chip of the first driver chip, and the identity of the previous driver chip is the identity of the termination driver chip, stopping action.

Optionally, the start driver chip is a first driver chip of the plurality of driver chips which are arranged according to the response feedback sequence.

Optionally, the identities of the plurality of driver chips are characters having sequential features, and the response feedback sequence is a sequence obtained by sequencing according to the sequential features of the identities.

Optionally, the identities of the plurality of driver chips are different numbers, and the response feedback sequence is a sequence in which the identities are arranged from small to large.

Optionally, the preamble is obtained by Manchester encoding of continuous at least 8 bits of binary 0;

the start identification comprises continuous at least 2 bits of binary 0;

the target data carried by the data bits is data obtained by Manchester encoding; and the stop identification comprises continuous at least 2 bits of binary 1.

Optionally, the one or more programs further comprise an instruction for performing the following operation:

in the a process of signal transmission via the first signal line, when the first driver chip has an abnormality, pulling the a signal on the first signal line low, such that the controller performs clock calibration operation according to the pulled-low signal.

According to a sixth aspect, there is provided a display device, comprising a controller and a plurality of driver chips, wherein the controller comprises a data transmission device according to the fourth aspect, and the plurality of driver chips comprises a data transmission device according to the fifth aspect.

According to a seventh aspect, there is provided a data transmission device, comprising a memory, a processor, and a computer program stored on the memory and operable capable of being executed by the processor, wherein when executing the computer program, the processor implements the a data transmission method according to the first aspect when executing the computer program.

According to an eighth aspect, there is provided a data transmission device, comprising a memory, a processor, and a computer program stored on the memory and capable of being executed by the processor, wherein the processor implements a data transmission method according to the second aspect when executing the computer program.

According to a ninth aspect, there is provided a computer readable storage medium, storing a computer program, wherein the computer program implements a data transmission method according to the first aspect when being executed by a processor.

According to a tenth aspect, there is provided a computer readable storage medium, storing a computer program, wherein the computer program implements a data transmission method according to the second aspect when being executed by a processor.

According to an eleventh aspect, there is provided a computer program product comprising instructions, wherein a computer performs a data transmission method according to the first aspect when the computer program product is running on the computer.

According to a twelfth aspect, there is provided a computer program product comprising instructions, wherein a computer performs a data transmission method according to the second aspect when the computer program product is running on the computer.

DETAILED DESCRIPTION

To make the purpose, embodiments and principles of the present application clearer, the embodiments of the present application will be described below in detail with reference to the accompanying drawings.

Figure 1:
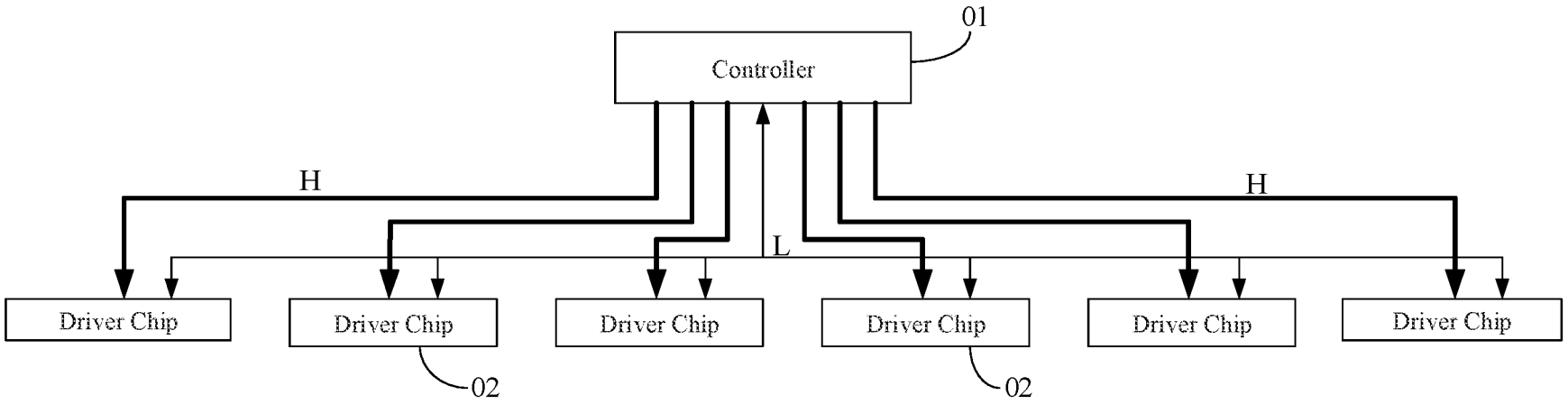
FIG. 1 is a schematic diagram of an application environment involved in respective embodiments of the present application.

Referring to FIG. 1, FIG. 1 is a schematic diagram of an application environment of a data transmission method according to an embodiment of the present application. As shown in FIG. 1, the data transmission method is applied to a display device. The display device includes a controller 01 and a plurality of driver chips 02. The driver chips are all connected to the controller 01, at least one of the plurality of driver chips 02 is also connected to a display panel, and the plurality of driver chips 02 has the transmission function of data returning. Exemplarily, the display panel may be an in-cell touch display panel, and the in-cell touch display panel is a display panel integrated with a touch function layer (referred to as a touch layer), that is, the structure of embedding the touch function layer into pixels of the display panel. The display panel may be an OLED (Organic Light-Emitting Diode) display panel or an LCD (Liquid Crystal Display) display panel. When the plurality of driver chips having the transmission function of data returning exists, the plurality of driver chips may be respectively connected to a plurality of touch signal output terminals of the in-cell touch display panel.

As shown in FIG. 1, the controller 01 is respectively connected to the plurality of driver chips 02 through a plurality of second signal lines H. Generally, the plurality of second signal lines H of the controller and the plurality of driver chips are connected in one to one correspondence, wherein the signals in the second signal lines are unidirectionally transmitted. The controller is further connected to a first signal line L, and the plurality of driver chips is connected in parallel and connected to the first signal line L. In the embodiment of the present application, the first signal line L has a bidirectional transmission function, and the plurality of driver chips is usually arranged according to a response feedback sequence. The response feedback sequence may be pre-configured, and may also be determined in real time, which is not limited by the embodiment of the present application. The controller may send a data request instruction to the plurality of driver chips via the first signal line, and receive, via the first signal line, data response instructions sequentially sent by the plurality of driver chips from a start driver chip according to the response feedback sequence, to obtain data of the driver chips. The response feedback sequence is used to identify the sequence in which the plurality of driver chips sends the data response instructions.

Exemplarily, each driver chip has an identity, the identities of the plurality of driver chips may be characters having sequential features, and the response feedback sequence is a sequence obtained by sequencing according to the sequential features of the identities. For example, the characters may be letters, numbers or characters. It is assumed that there are 4 driver chips, and the identities of the 4 driver chips may be: a, b, c, and d, or: 4, 3, 2, and 1, or: A, B, C, and D.

For example, the identities of the plurality of driver chips may be different numbers, and the response feedback sequence may be the sequence in which the identities are arranged from small to large. It is assumed that there are 4 driver chips: X1, X2, X3 and X4. The identity of X1 is 4, the identity of X2 is 3, the identity of X3 is 2, and the identity of X4 is 1. The response feedback sequence can be the sequence of the four identities from small to large. X4 has the smallest identity, and X1 has the largest identity, so after sequencing, the sequence of X4, X3, X2, and X1 can be obtained. In addition, when the identities of the plurality of driver chips are different numbers, the response feedback sequence may also be the sequence of the identities from large to small, which is not limited by the embodiment of the present application.

Figure 2:
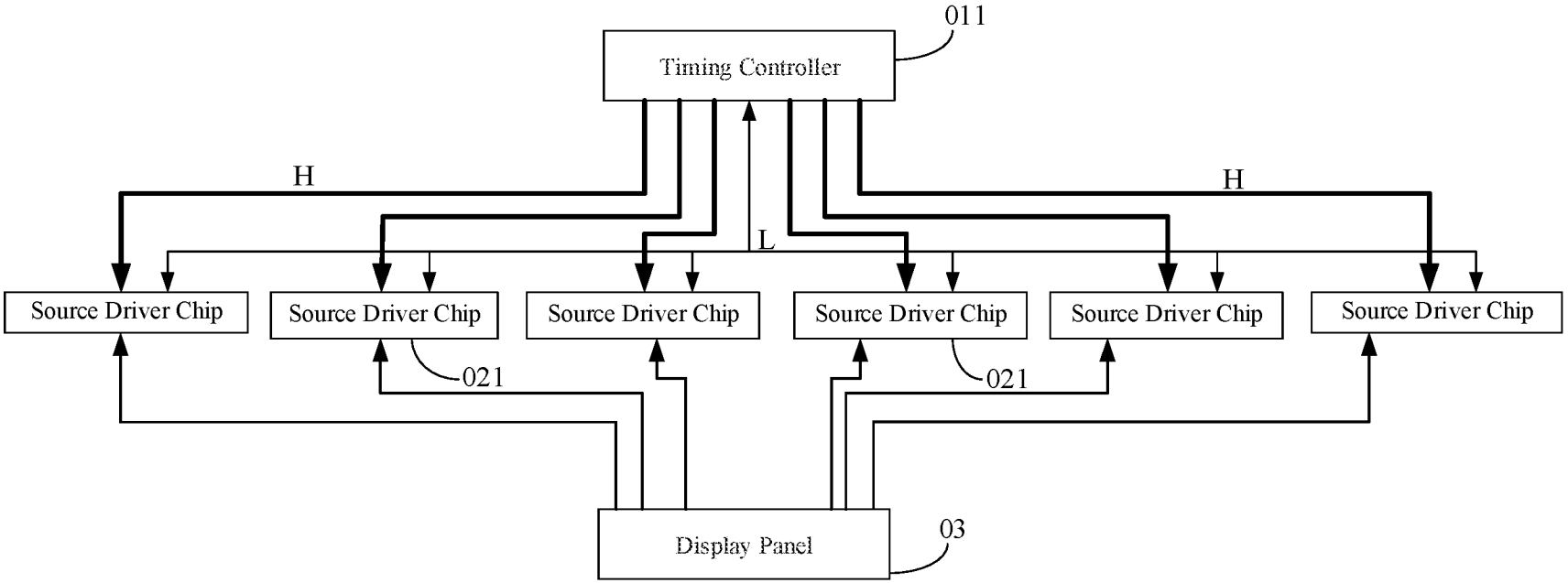
FIG. 2 is a schematic diagram of another application environment involved in respective embodiments of the present application.

The above driver chips may be source driver chips or gate driver chips. The controller may be any one of a timing controller, a system on chip (SOC), and a microcontroller unit (MCU) integrated in the timing controller. FIG. 2 illustrates an example in which the controller is the timing controller 011 and the driver chip is the source driver chip 021. As shown in FIG. 2, the timing controller 011 is connected to the plurality of source driver chips 021 in one-to-one correspondence through a plurality of second signal lines H respectively. The timing controller 011 is further connected to a first signal line L. The plurality of source driver chips 021 is connected in parallel and connected to the first signal line L. The first signal line L can identify a level state. For example, via the first signal line L, a pin of the source driver chip is set to a high level or a low level.

In the application environment shown in FIG. 2, it is assumed that the plurality of source driver chips 021 is connected in parallel and is connected to the timing controller 011 via the first signal line and the second signal lines, and the plurality of source driver chips 021 is connected to the display panel 03, which is however not limited by the embodiment of the present application.

The second signal line may be a high-speed signal line, and the first signal line may be a low-speed signal line. It should be noted that, it is assumed that the signal line for connecting the above display panel and the driver chip is a third signal line, and the third signal line may also be a high-speed signal line, that is, the signal transmission rate of the second signal line and the signal transmission rate of the third signal line are both greater than the signal transmission rate of the first signal line. For example, the second signal line and the third signal line are differential signal lines, and the first signal line is a normal signal line.

In the panel driving circuit of the conventional display device, the first signal line (low-speed signal line) L can only identify the level state. For example, the pin of the source driver chip is set to a high level or a low level via the first signal line L. The first signal line has a single function and a relatively low utilization rate. In the panel driving circuit of the conventional display device, the timing controller cannot obtain the data of the source driver chip via the first signal line L, which limits the implementation of certain functions, such as a touch function and an OLED (Organic Light-Emitting Diode) compensation function. The touch function requires the scanning of the position of a touch coordinate point at a higher frequency. That is, the source driver chip is required to send the data to the timing controller in real time to notify the timing controller whether a touch operation and the touch coordinate point are detected. When the function is implemented, the source driver chip is used for touch driving and display driving. The OLED compensation function requires real-time adjustment of the color and brightness of a certain position picture in the display process, to avoid the phenomenon of color cast or color non-uniformity. In order to achieve this OLED compensation function, the current, voltage and other relevant state data of a current position need to be used as the original data on which the compensation operation is based, which requires the source driver chip to send the current display data of the source driver chip to the timing controller in real time.

In the embodiment of the present application, the first signal line L can perform data transmission in addition to the identifying of the level state. The timing controller can acquire the data of the source driver chip via the first signal line L, thereby implementing various functions. For example, when the touch function is implemented, the timing controller can obtain the data of the source driver chip in real time via the first signal line L, and then scan the position of the touch coordinate point at a higher frequency. When the OLED compensation function is implemented, the timing controller can obtain the display data of the source driver chip in real time via the first signal line L, use the display data as the original data on which the compensation operation is based, and then perform the compensation operation, thereby adjusting the color and brightness of the current position picture in real time, and avoiding the phenomenon of color cast or color non-uniformity.

Figure 3:
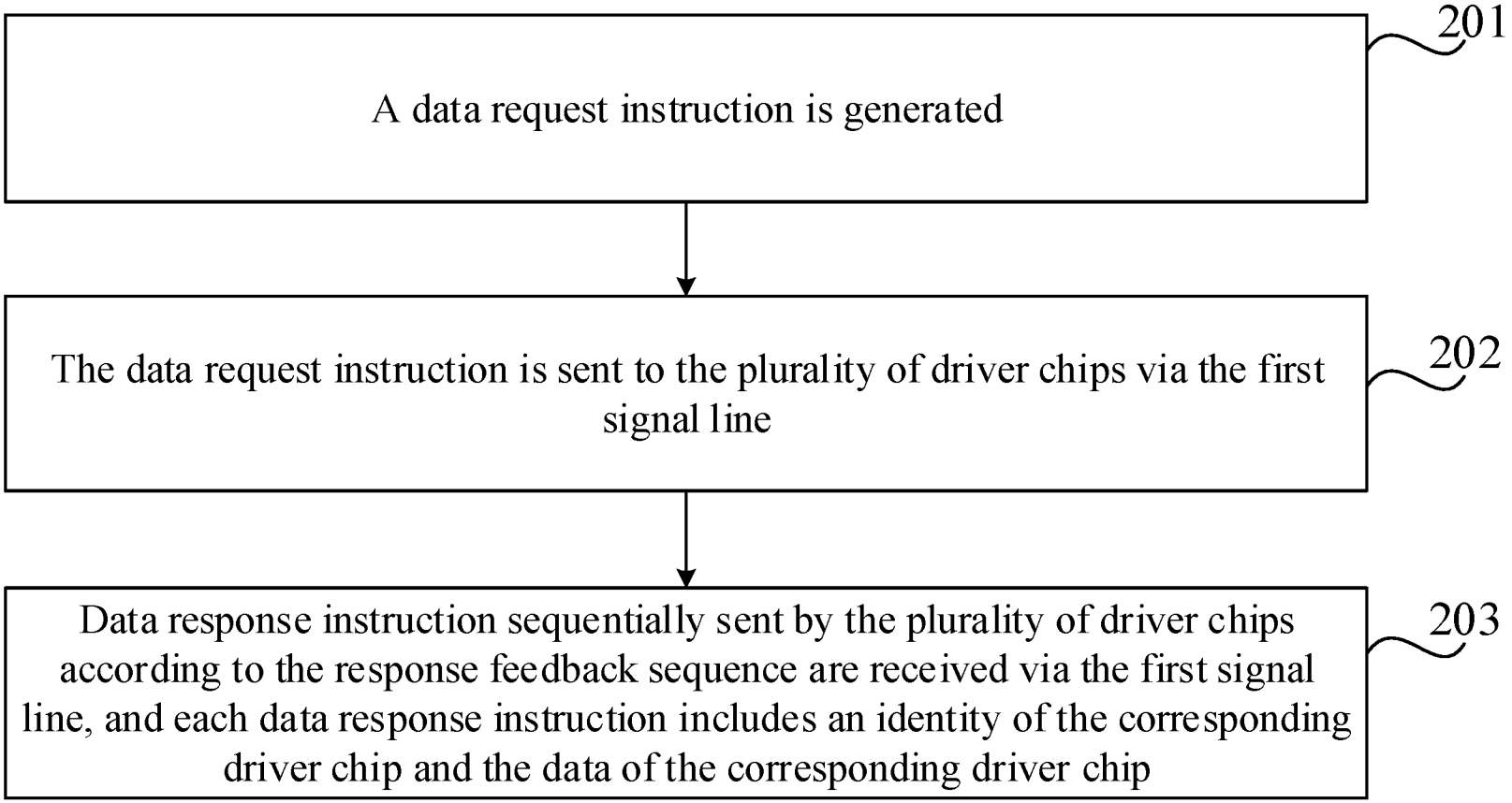
FIG. 3 is a schematic flowchart of a data transmission method according to an embodiment of the present application.

Referring to FIG. 3, FIG. 3 is a schematic flowchart of a data transmission method according to an embodiment of the present application. The data transmission method can be applied to the controller in FIG. 1, and the controller is connected to a plurality of driver chips connected in parallel via the first signal line, wherein the plurality of driver chips is sequenced according to a response feedback sequence. As shown in FIG. 3, the method includes the following steps.

In step 201, a data request instruction is generated.

Optionally, the data request instruction includes an identity of the start driver chip, and the start driver chip is a driver chip of the plurality of driver chips.

In step 202, the data request instruction is sent to the plurality of driver chips via the first signal line.

In step 203, data response instruction sequentially sent by the plurality of driver chips according to the response feedback sequence are received via the first signal line, and each data response instruction includes an identity of the corresponding driver chip and the data of the corresponding driver chip.

Optionally, when the data request instruction comprises the identity of the start driver chip, the implementation process of step 203 may include: receiving, via the first signal line, data response instructions sequentially sent by the plurality of driver chips from the start driver chip according to the response feedback sequence. In the embodiment of the present application, the controller receives, via the first signal line, the data response instructions sequentially sent by the plurality of driver chips from the start driver chip from front to back according to the response feedback sequence. The response feedback sequence indicates that the plurality of driver chips is sequenced, and the arrangement positions of the plurality of driver chips can also be arranged in the arranging sequence.

In summary, according to the data transmission method provided by the embodiment of the present application, the controller can generate the data request instruction, and then send the data request instruction via the first signal line. Afterwards, the data response instructions sequentially sent by the plurality of driver chips (for example, sequentially sent by the plurality of driver chips from the start driver chip according to the feedback sequence) are received via the first signal line. Compared with the related art, the controller can acquire the data of the driver chip via the first signal line, thereby enriching the function of the first signal line and improving the utilization rate of the first signal line.

Figure 4:
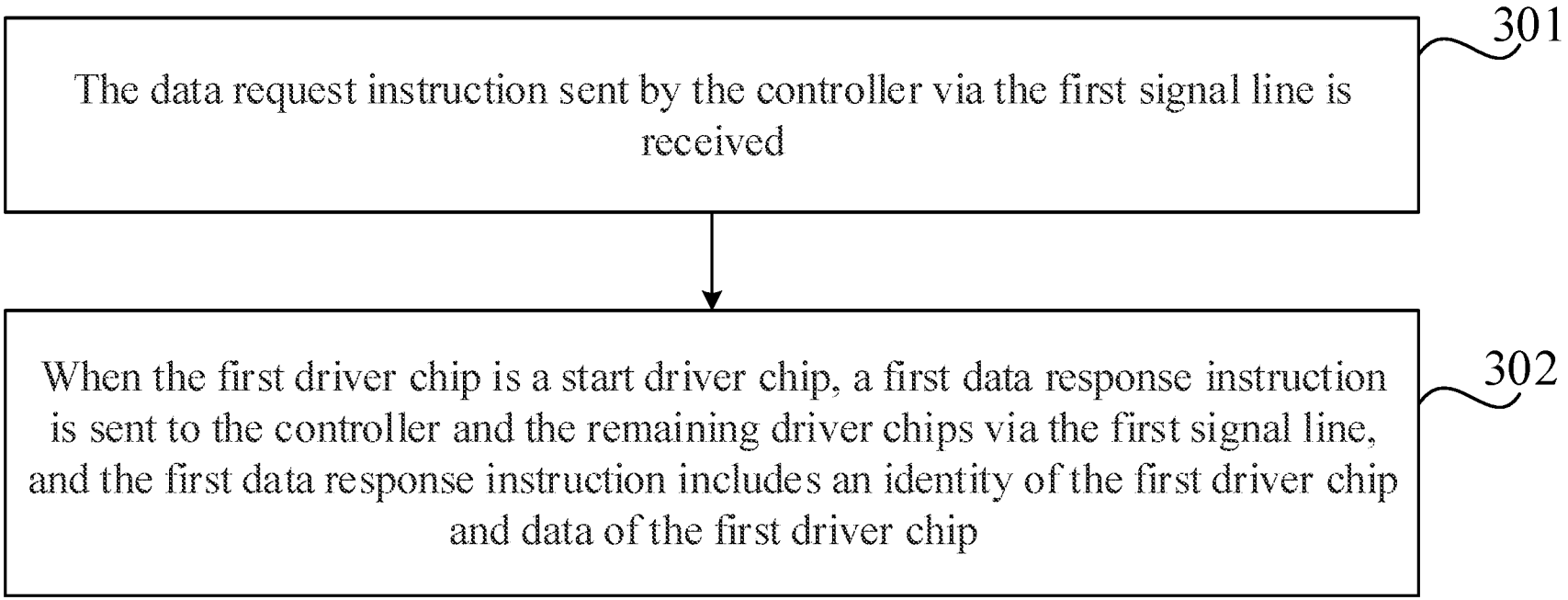
FIG. 4 is a schematic flowchart of another data transmission method according to an embodiment of the present application.

Referring to FIG. 4, FIG. 4 is a schematic flowchart of another data transmission method according to an embodiment of the present application. The data transmission method may be applied to the first driver chip in FIG. 1. The first driver chip is any one of the plurality of driver chips, and the plurality of driver chips is connected in parallel, and is connected to the controller via the first signal line. The plurality of driver chips is sequenced according to a response feedback sequence. As shown in FIG. 4, the method includes the following steps.

In step 301, the data request instruction sent by the controller via the first signal line is received.

Optionally, when the data request instruction sent by the controller via the first signal line is received, whether the identity of the start driver chip carried in the data request instruction is the identity of the first driver chip is detected.

In step 302, when the first driver chip is a start driver chip, a first data response instruction is sent to the controller and the remaining driver chips via the first signal line, and the first data response instruction includes an identity of the first driver chip and data of the first driver chip.

Optionally, when the data request instruction comprises an identity of the start driver chip, whether the first driver chip is the start driver chip may be determined according to the identity of the start driver chip and identity of the first driver chip. Correspondingly, the implementation process of step 302 may include: after detecting that the identity of the start driver chip is the identity of the first driver chip, a first data response instruction is sent to the controller and the remaining driver chips via the first signal line.

The first data response instruction is used to trigger the plurality of driver chips to sequentially send the data response instructions from the first driver chip behind the first driver chip according to the response feedback sequence. That is, the first data response instruction is used to trigger driver chips behind the first driver chip in the plurality of driver chips to sequentially send data response instructions according to the response feedback sequence. Each of the data response instructions includes the identity of the corresponding driver chip and the data of the corresponding driver chip.

In summary, according to the data transmission method provided by the embodiment of the present application, after the first driver chip detects that the identity of the start driver chip carried in the data request instruction is the identity of the first driver chip, the first driver chip can send the first data response instruction to the controller and the remaining driver chips via the first signal line according to the data request instruction. The first data response instruction includes the identity of the first driver chip and the data of the first driver chip. Compared with the related art, the driver chip can transmit the data of the driver chip to the controller via the first signal line, thereby enriching the function of the first signal line and improving the utilization rate of the first signal line.

Figure 5:
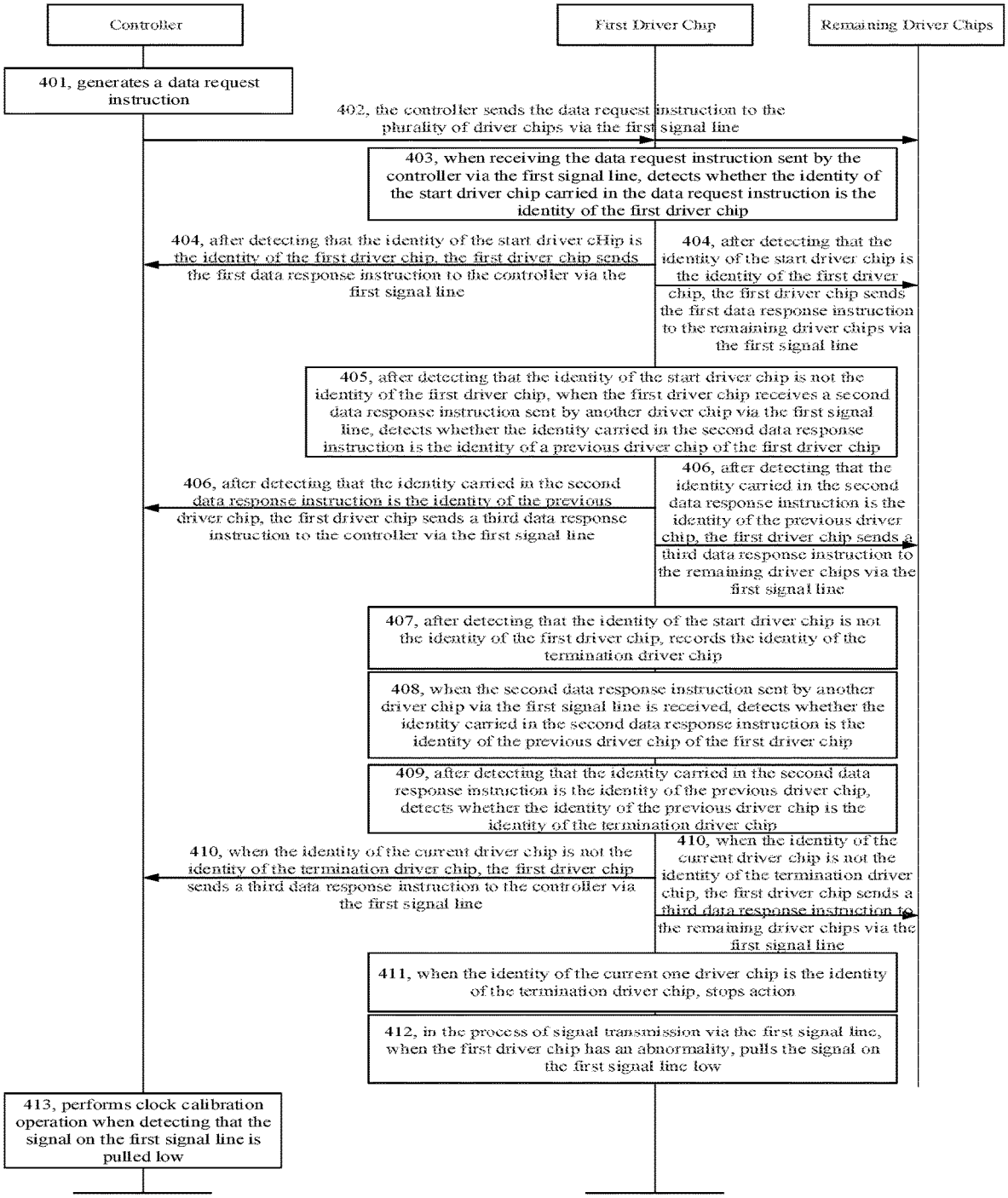
FIG. 5 is a schematic flowchart of yet another data transmission method according to an embodiment of the present application.

Referring to FIG. 5, FIG. 5 is a schematic flowchart of yet another data transmission method according to an embodiment of the present application. The data transmission method may be applied to the application environment shown in FIG. 1. Referring to FIG. 1, the controller is connected to a plurality of driver chips connected in parallel via the first signal line, and the plurality of driver chips is sequenced according to a response feedback sequence. As shown in FIG. 5, the method may include the following steps.

In step 401, the controller generates a data request instruction.

The data request instruction includes an identity of the start driver chip, and the start driver chip is a driver chip of the plurality of driver chips.

In the embodiment of the present application, the controller may perform basic configuration on the plurality of driver chips in a broadcast manner based on the first signal line in advance, so that the driver chip has the function of data returning, and then step 401 is performed. For example, the controller may configure the identity of each driver chip in advance. Exemplarily, the controller may configure the identity of the driver chip by setting the pin of the driver chip to a high level or a low level, or may configure the identity of the driver chip by using a manner of writing an instruction into the driver chip.

In step 402, the controller sends the data request instruction to the plurality of driver chips via the first signal line.

Exemplarily, the controller may simultaneously send the data request instruction to the plurality of driver chips via the first signal line according to a preset frequency. The preset frequency may be 500 KHz (kilohertz).

In step 403, when receiving the data request instruction sent by the controller via the first signal line, the first driver chip detects whether the identity of the start driver chip carried in the data request instruction is the identity of the first driver chip.

It is assumed that the first driver chip is any one of the plurality of driver chips. The first driver chip detects whether the identity of the start driver chip carried in the data request instruction is the identity of the first driver chip, so as to determine whether the first driver chip is the start driver chip.

In step 404, after detecting that the identity of the start driver chip is the identity of the first driver chip, the first driver chip sends the first data response instruction to the controller and the remaining driver chips via the first signal line.

The remaining driver chips refer to the driver chips except the first driver chip of the plurality of driver chips connected to the first signal line and connected in parallel.

When detecting that the identity of the start driver chip is the identity of the first driver chip, it is indicated that the first driver chip is the start driver chip, and then the first driver chip sends the first data response instruction to the controller and the remaining drivers via the first signal line, and the first data response instruction includes the identity of the first driver chip and data of the first driver chip.

The first data response instruction is used to trigger the plurality of driver chips to sequentially send the data response instructions from the first driver chip behind the first driver chip according to the response feedback sequence, wherein each of the data response instructions includes the identity of the corresponding driver chip and the data of the corresponding driver chip.

Exemplarily, the three driver chips are connected in parallel and connected to the controller via the first signal line. The three driver chips are: X1, X2 and X3, respectively. The identities of the three driver chips are X1, X2 and X3, respectively, and the three driver chips are sequenced according to the response feedback sequence: X1, X2 and X3. It is assumed that the first driver chip is X1, and the identity of the start driver chip carried in the data request instruction sent by the controller via the first signal line is X1. X1 detects that the identity of the start driver chip carried in the data request instruction is the identity of the first driver chip, and then X1 sends the first data response instruction to the controller, X2 and X3 via the first signal line.

Optionally, in the embodiment of the present application, the formats of the instructions transmitted between the controller and the driver chip are the same, and each instruction transmitted on the first signal line includes a preamble, a start identification, data bits (also known as transaction body) and a stop identification. Optionally, the instructions transmitted via the first signal line comprises data request instructions and data response instructions.

The preamble is used to indicate that a recipient device performs clock calibration and phase calibration, and the recipient device (the timing controller or the source driver chip) performs clock and phase adjustment according to the content of the preamble when detecting the transmission of the preamble on the first signal line. The clock and phase calibration means that the clock is kept consistent with the clock at the sender device, and the phase is the same as the sender device. The recipient device adjusts the clock and phase during the process of receiving the preamble, and after the transmission of the preamble is stopped, the clock and phase are adjusted completely. The start identification is used to indicate the start of data transmission, the data bits are used to carry the target data, and the stop identification is used to indicate the stop of the data transmission.

Figure 6:
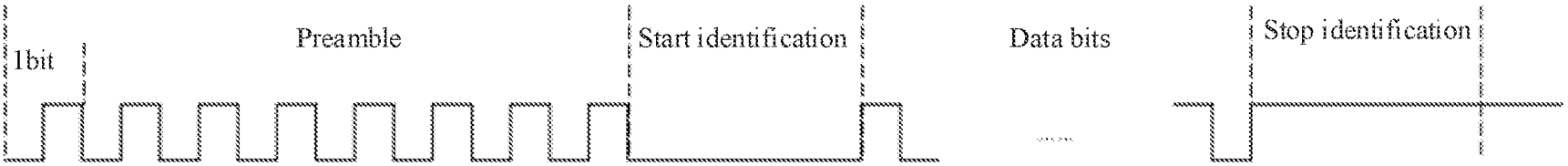
FIG. 6 is a schematic diagram of a format of an instruction transmitted on a first signal line according to an embodiment of the present application.

Exemplarily, the preamble can be obtained by Manchester encoding of continuous at least 8 bits of binary 0. FIG. 6 is a schematic diagram of a format of an instruction transmitted on a first signal line according to an embodiment of the present application. As shown in FIG. 6, FIG. 6 schematically illustrates that the preamble is obtained by the Manchester encoding of continuous 8 bits of binary 0. The start identification can keep a low-level signal without performing Manchester encoding. The start identification may include continuous at least 2 bits of binary 0. FIG. 6 schematically illustrates with continuous 2 bits of binary 0 as the start identification. The target data carried by the data bits is data obtained by the Manchester encoding. The stop identification can keep a high-level signal without performing the Manchester encoding, the stop identification may include continuous at least 2 bits of binary 1, and FIG. 6 schematically illustrates with continuous 2 bits of binary 1 as the stop identification.

Since the Manchester encoding can be used to cause the data to generate an obvious hopping edge, and the detection of the data is facilitated. Therefore, the data to be encoded in the embodiment of the present application may adopt the Manchester encoding. Optionally, other encoding manners may also be used, or no encoding is performed.

Exemplarily, in the embodiment of the present application, in order to ensure that the target data carried by the data bits can be effectively identified at a decoder device, referring to FIG. 6, the first bit of the target data in the data bits may generate a hopping edge with the start identification, (i.e., the first bit of the target data in the data bits is different from the last bit value of the start identification, for example, the first bit of the target data in the data bits is 1, and the last bit of the start identification is 0). The last bit of the target data in the data bits may generate a hopping edge with the stop identification (i.e., the last digit of the target data in the data bits is different from the first bit value of the stop identification, for example, the last digit of the target data in the data bits is 0, and the first bit of the stop identification is 1). The above hopping edge facilitates effective identification of the data at the recipient device.

Figure 7:
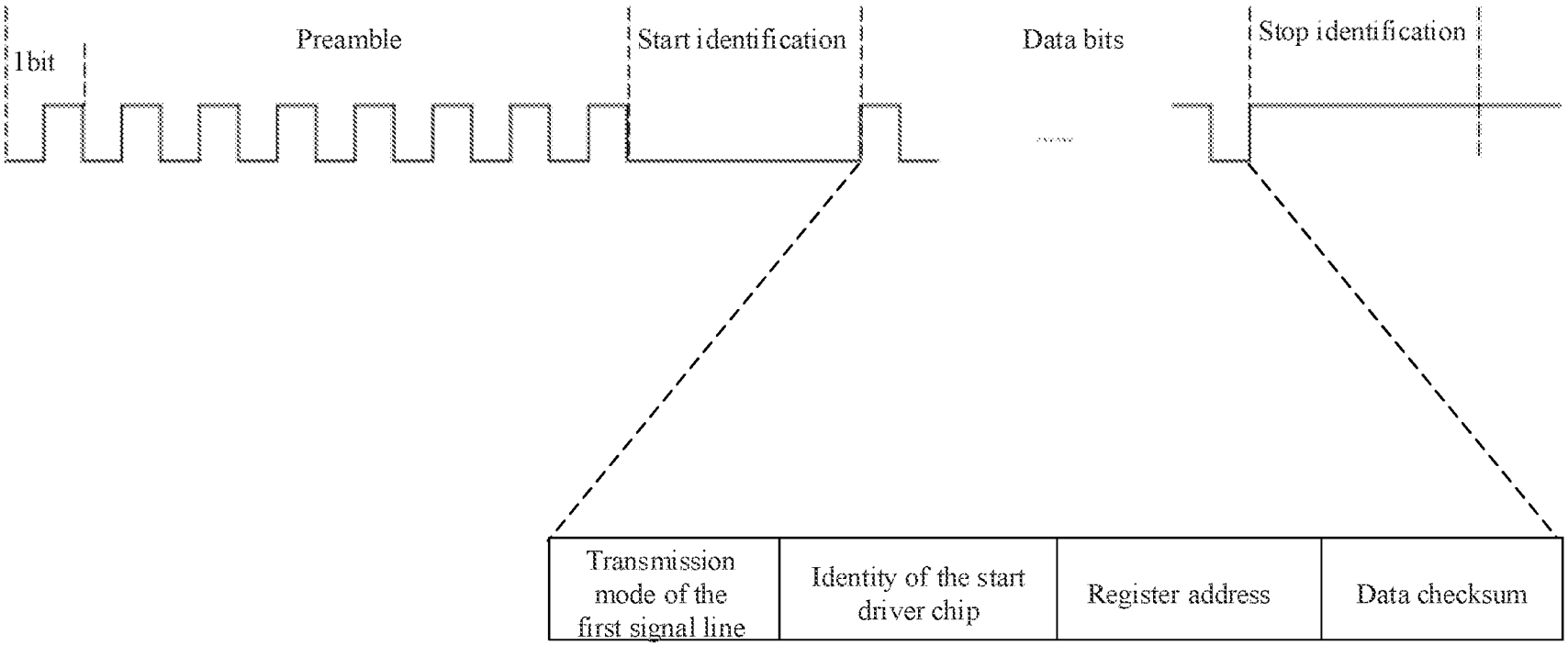
FIG. 7 is a schematic diagram of target data carried by data bits of a data request instruction according to an embodiment of the present application.

FIG. 7 is a schematic diagram of target data carried by data bits of a data request instruction according to an embodiment of the present application. As shown in FIG. 7, the target data carried by the data bits of the data request instruction generated by the controller may include: a transmission mode of the first signal line, an identity of the start driver chip, a register address configured on the plurality of driver chips, and a data checksum. The transmission mode of the first signal line is a bust read mode, and the bust read mode indicates that the controller receives the data sequentially sent by the plurality of driver chips from the start driver chip according to the response feedback sequence. Exemplarily, the signal of the transmission mode of the first signal line can occupy 2 bits in the data bits. The data checksum in the data bits is used to ensure the accuracy of the data received at the recipient device. In the embodiment of the present application, since the register addresses configured on different driving chips in the plurality of driving chips are the same, the register address configured on the plurality of driver chips may be understood as a register address configured on each driver chip in the plurality of driver chips.

Figure 8:
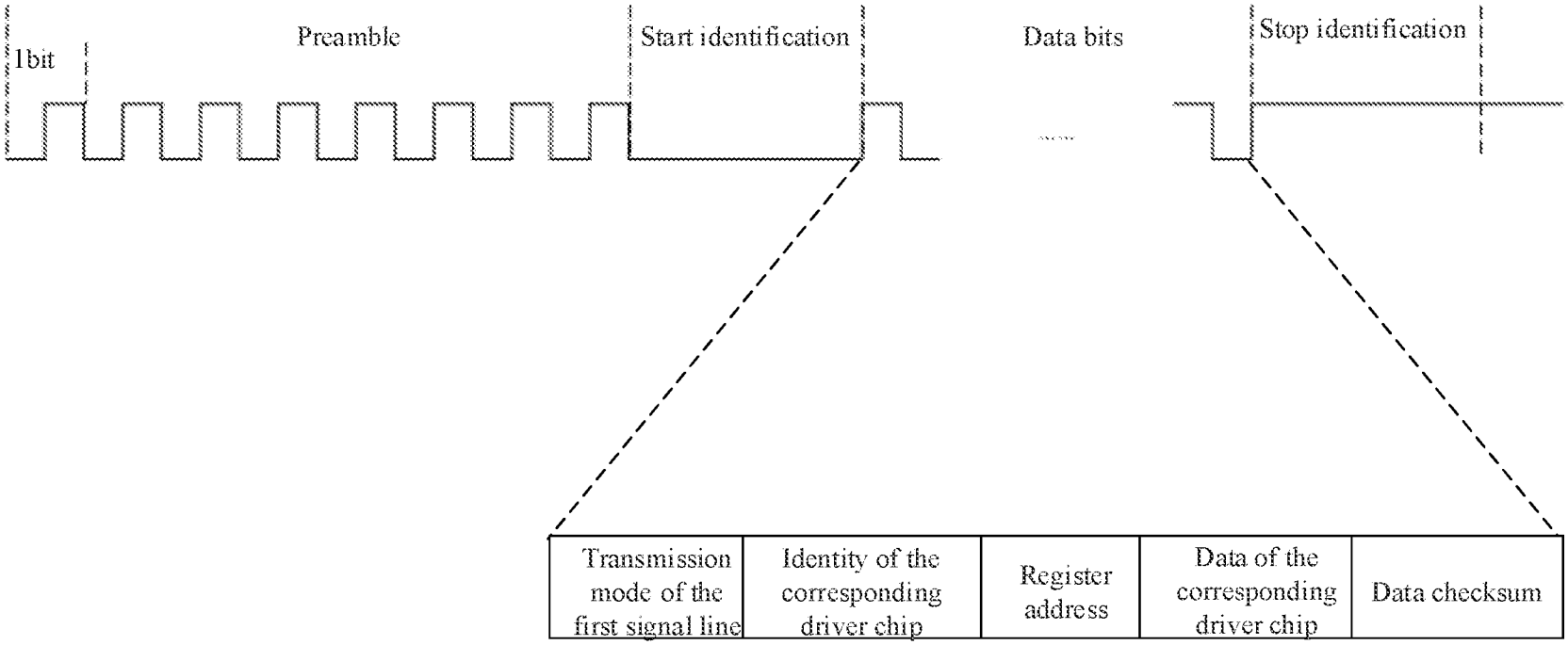
FIG. 8 is a schematic diagram of target data carried by data bits of a data response instruction according to an embodiment of the present application.

FIG. 8 is a schematic diagram of target data carried by data bits of a data response instruction according to an embodiment of the present application. As shown in FIG. 8, the target data carried by the data bits of each data response instruction includes: a transmission mode of the first signal line, an identity of the corresponding driver chip, a register address configured on the plurality of driver chips, data of the corresponding driver chip, and a data checksum. The transmission mode of the first signal line is a reply transmission mode, and the reply transmission mode indicates the driver chip to perform instruction reply on the controller.

In the embodiment of the present application, the first driver chip may be the last one of the plurality of driver chips, or may not be the last one of the plurality of driver chips. When the first driver chip is the last one of the plurality of driver chips, under the condition that the identity of the start driver chip is the identity of the first driver chip in the data request instruction, the controller may receive the data response instruction sent by the first driver chip via the first signal line, thereby enriching the function of the first signal line, and improving the utilization rate of the first signal line. When the first driver chip is not the last one of the plurality of driver chips, under the condition that the identity of the start driver chip is the identity of the first driver chip in the data request instruction, the controller sends an data request instruction via the first signal line, the data sent by the plurality of driver chips can be received via the first signal line, and the data of the plurality of driver chips are read at one step. In the process, the number of times that the data request instruction is sent is relatively small, the time required for the plurality of driver chips to return data is relatively short, and the efficiency of data returning is relatively high.

In the embodiment of the present application, when the start driver chip is different from the last one of the plurality of driver chips (that is, the start driver chip is not the last one of the plurality of driver chips), receiving, by the controller through the first signal line, the data response instructions sequentially sent by the plurality of driver chips from the start driver chip according to the response feedback sequence may include: the controller receives the data response instructions sequentially sent by the plurality of driver chips from the start driver chip to the last driver chip according to the response feedback sequence. The last driver chip is the last driver chip of the plurality of driver chips sequenced according to the response feedback sequence. When the first driver chip is not the start driver chip, the first driver chip may perform the following steps 405 to 406.

In step 405, after detecting that the identity of the start driver chip is not the identity of the first driver chip, when the first driver chip receives a second data response instruction sent by another driver chip via the first signal line, the first driver chip detects whether the identity carried in the second data response instruction is the identity of a previous driver chip of the first driver chip.

For example, when the identity of the start driver chip carried in the data request instruction is not the identity of the first driver chip, the driver chip of which the identity is the same as the identity of the start driver chip sends the data response instruction to the remaining driver chips according to the data request instruction sent by the controller. It is assumed that the data response instruction is the second data response instruction, then the first driver chip receives the second data response instruction sent by another driver chip (i.e., the driver chip of which the identity is the same as the identity of the start driver chip) via the first signal line. When the second data response instruction is received, the first driver chip detects whether the identity carried in the second data response instruction is the identity of the previous driver chip of the first driver chip, so as to conveniently determine whether the corresponding data response instruction is sent via the first signal line.

In step 406, after detecting that the identity carried in the second data response instruction is the identity of the previous driver chip, the first driver chip sends a third data response instruction to the controller and the remaining driver chips via the first signal line.

The third data response instruction includes the identity of the first driver chip and the data of the first driver chip.

The third data response instruction is used to trigger the plurality of driver chips to sequentially send the data response instructions from the first driver chip behind the first driver chip according to the response feedback sequence. Each data response instruction includes the identity of the corresponding driver chip and the data of the corresponding driver chip.

Optionally, the start driver chip is the first driver chip of the plurality of driver chips sequenced according to the response feedback sequence. It is assumed that there are three driver chips: X1, X2 and X3. The three driver chips are sequenced according to the response feedback sequence: X1, X2 and X3. That is, the first driver chip of the three driver chips arranged according to the response feedback sequence is X1, and then the start driver chip is X1. By steps 401 to 406, X1 detects that the identity of the start driver chip carried in the data request instruction sent by the controller via the first signal line is the identity of X1, and X1 sends the data response instruction to the controller and the remaining driver chips via the first signal line. The data response instruction includes the identity of X1 and the data of X1. X2 detects that the identity carried in the data response instruction sent by X1 is the identity of the previous driver chip (i.e. X1) of X2. X2 sends the data response instruction to the controller and the remaining driver chips via the first signal line, the data response instruction includes the identity of X2 and the data of X2. X3 detects that the identity carried in the data response instruction sent by X2 is the identity of the previous driver chip (i.e. X2) of X3. X3 sends the data response instruction to the controller and the remaining driver chips via the first signal line, and the data response instruction includes the identity of X3 and the data of X3.

In the embodiment of the present application, when the first driver chip is not the start driver chip and is not the last one of the plurality of driver chips, by performing steps 401 to 406, the controller may sequentially receive the data sent by the plurality of driver chips, thereby realizing data reading of the plurality of driver chips at one step. When the start driver chip is the first driver chip arranged by the plurality of driver chips according to the response feedback the sequence, the controller may sequentially receive the data sent by all the driver chips, so as to read the data of all the driver chips at one step.

Figure 9:
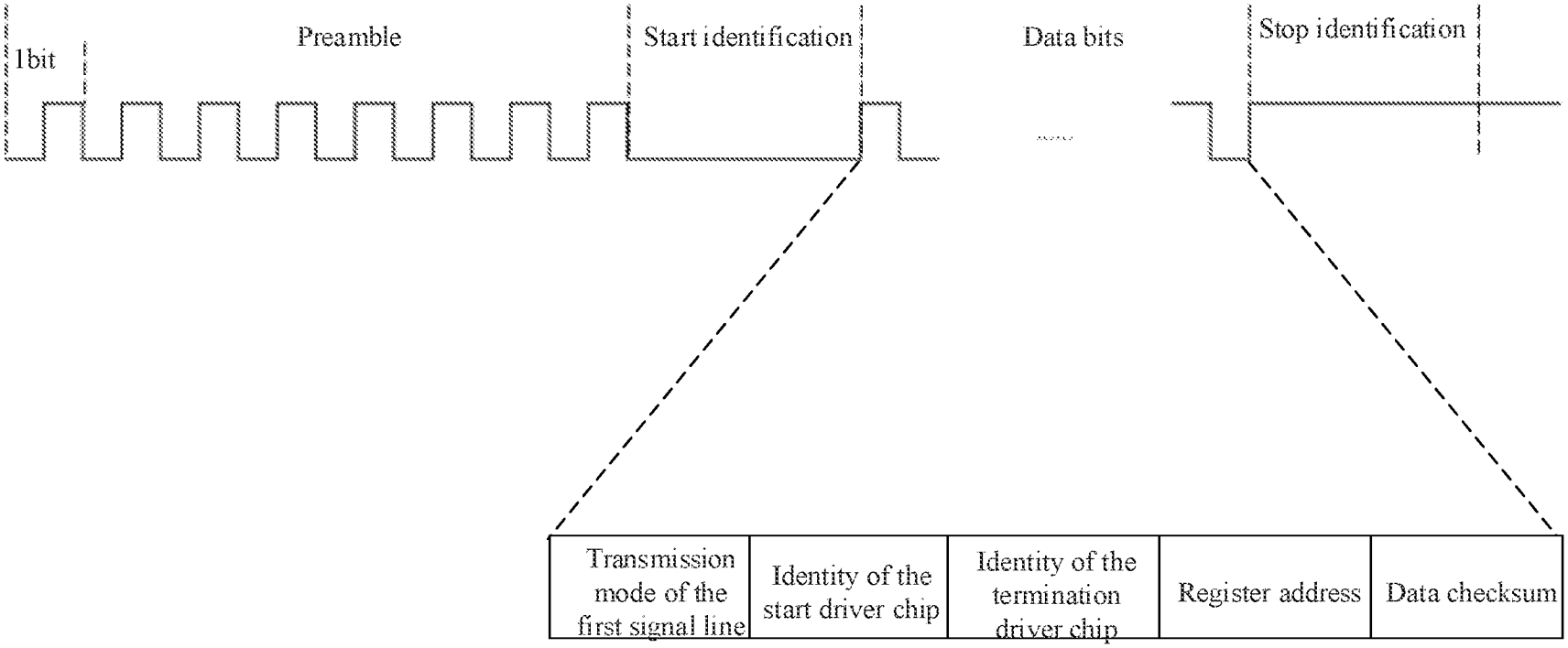
FIG. 9 is a schematic diagram of target data carried by data bits of another data response instruction according to an embodiment of the present application.

Optionally, the data request instruction sent by the controller may further include the identity of a termination driver chip, and the termination driver chip is a driver chip behind the start driver chip in the plurality of driver chips. In this case, the controller may receive the data response instructions sent by the specified plurality of driver chips via the first signal line. FIG. 9 illustratively shows a schematic diagram of a data request instruction including the identity of the termination driver chip. Exemplarily, the position of the identity of the termination driver chip can be located behind the identity of the start driver chip in the data request instruction. Receiving, by the controller via the first signal line, the data response instructions sequentially sent by the plurality of driver chips from the start driver chip according to the response feedback sequence may include: the controller receives the data response instructions sent by the plurality of driver chips via the first signal line from the start driver chip according to the response feedback sequence to the termination drive chip. For the first driver chip, when the data request instruction further includes the identity of the termination driver chip, the first driver chip may further perform the following steps 407 to 411.

In step 407, after detecting that the identity of the start driver chip is not the identity of the first driver chip, the first driver chip records the identity of the termination driver chip.

In step 408, when the second data response instruction sent by another driver chip via the first signal line is received, the first driver chip detects whether the identity carried in the second data response instruction is the identity of the previous driver chip of the first driver chip.

In step 409, after detecting that the identity carried in the second data response instruction is the identity of the previous driver chip, the first driver chip detects whether the identity of the previous driver chip is the identity of the termination driver chip.

In step 410, when the identity of the current driver chip is not the identity of the termination driver chip, the first driver chip sends a third data response instruction to the controller and the remaining driver chips via the first signal line.

The third data response instruction includes the identity of the first driver chip and the data of the first driver chip.

In step 411, when the identity of the current one driver chip is the identity of the termination driver chip, the first driver chip stops action.

The third data response instruction is used to trigger the plurality of driver chips to sequentially send the data response instructions from the first driver chip behind the first driver chip according to the response feedback sequence, wherein each of the data response instructions includes the identity of the corresponding driver chip and the data of the corresponding driver chip.

Optionally, the start driver chip is the first driver chip in the plurality of driver chips sequenced according to the response feedback sequence. It is assumed that there are three driver chips: X1, X2 and X3. The three driver chips are sequenced according to the response feedback sequence: X1, X2 and X3. That is, the first driver chip of the three driver chips arranged according to response feedback sequence is X1, and then the start driver chip is X1. The termination driver chip is the driver chip X2 located behind the start driver chip. X1. By performing step 403 to step 404, that the identity of the start driver chip carried in the data request instruction sent by the controller via the first signal line is the identity of X1 is detected, and X1 sends the data response instruction to the controller and the remaining driver chips via the first signal line, wherein the data response instruction includes the identity of X1 and the data of X1. X2 performs step 407 to step 410 to record the identity of the termination driver chip X2, and detects that the identity carried in the data response instruction sent by X1 is the identity of the previous driver chip of X2, and the identity of the previous driver chip is not the identity of the termination driver chip. X2 sends the data response instruction to the controller and the remaining driver chips via the first signal line. The data response instruction includes the identity of X2 and the data of X2. X3 records the identity of the termination driver chip X2 by performing steps 407 to 410, and detects that the identity carried in the data response instruction sent by X2 is the identity of the previous driver chip of X3, and the identity of the previous driver chip is the identity of the termination driver chip, and X3 stops action, that is, does not send the data response instruction including the identity of X3 and the data of X3 to the controller and the remaining driver chips via the first signal line.

In the embodiment of the present application, by performing step 407 to step 411, the controller may sequentially receive the data sent by the specified plurality of driver chips according to actual requirements, so as to realize the data reading of the specified plurality of driver chips at one step, and the obtaining of the data not required is avoided. The specified plurality of driver chips is the driver chips of which the identities belong to the range from the identity of the start driver chip to the identity of the termination driver chip. For example, if there are 12 driver chips in total, the controller can only receive the data sent by the first 4 driver chips.

In addition, in the embodiment of the present application, when the termination driver chip sends the data response instruction to the controller, the data bits of the data response instruction may carry a terminator for indicating that the driver chip which currently sends the data response instruction to the controller is the termination driver chip. In this way, when the latter driver chip receives the data response instruction, if it is detected that the data bits of the data response instruction carry the terminator, the operation is stopped. For example, the terminator may be a preset symbol such as "*" and "#". In addition, in order to obtain the data of the specified plurality of driver chips, the controller may also filter out the required data from the data sent by all the driver chips after receiving the data sent by all the driver chips.

In order to ensure effective transmission of the data, the time intervals between two adjacent instructions transmitted on the first signal line are equal to a preset duration. For example, the preset duration may be 10 microseconds.

In step 412, in the process of signal transmission via the first signal line, when the first driver chip has an abnormality, the first driver chip pulls the signal on the first signal line low.

In step 413, the controller performs clock calibration operation when detecting that the signal on the first signal line is pulled low. The signal transmitted via the first signal line includes the data request instruction and the data response instruction.

In the embodiment of the present application, in the process that the driver chips return data to the controller in real time, the driver chips may not normally work based on the second signal line (the second signal lines may be referred to as high-speed signal lines, and are usually used to transmit high-speed differential signals) due to some external factors, thereby causing the lock losing of the clock and that the controller cannot transmit the high-speed differential signals to the driver chips by the second signal lines. At this point, the clock state feedback can be performed via the first signal line with bidirectional transmission. Since the controller is connected to the plurality of driver chips connected in parallel via the first signal line, when any of the driver chips is abnormal, the driver chip pulls the signal on the first signal line low. At this point, no other data is transmitted on the first signal line to the controller, then the controller can receive a low-level signal of a period of time, and determine that the current driver chip has the clock lock losing state, and then the controller performs the clock calibration operation, thereby avoiding the phenomenon of incapability of restoring caused by the clock lock losing state, and avoiding affecting the basic application of a point-to-point interface architecture.

In summary, according to the data transmission method provided by the embodiment of the present application, the controller can generate the data request instruction, and then send the data request instruction via the first signal line. Afterwards, the data response instructions sequentially sent by the plurality of driver chips from the start driver chip according to the response feedback sequence are received via the first signal line. Compared with the related art, the controller can acquire the data of the driver chip via the first signal line, thereby enriching the function of the first signal line and improving the utilization rate of the first signal line.

It should be noted that the sequence of the steps of the data transmission method provided by the embodiment of the present application may be appropriately adjusted, and the steps may also be correspondingly increased or decreased according to the condition. The methods that can be easily conceived by any skilled in the art within the scope of the present application are covered by the scope of the present application and therefore will not be described again.

The embodiment of the present application further provides a data transmission system, referring to FIG. 2, including a timing controller and a plurality of source driver chips connected in parallel. The timing controller is connected to the plurality of driver chips connected in parallel via the first signal line. The plurality of source driver chips is sequenced according to a response feedback sequence. The plurality of source driver chips comprises an start source driver chip, and the start source driver chip is different from the last one of the plurality of source driver chips.

The timing controller is used to generate a data request instruction, and send the data request instruction via the first signal line. Optionally, the data request instruction includes the identity of the start source driver chip.

The start source driver chip is used to send a first data response instruction to the timing controller and the remaining source driver chips via the first signal line when the data request instruction is received, and the first data response instruction includes an identity of the start source driver chip and data of the start source driver chip.

Each of the source driver chips behind the start source driver chip is used to detect whether the identity carried in a second data response instruction is the identity of the previous source driver chip of the source driver chip when the second data response instruction sent by another source driver chip via the first signal line is received. After detecting that the identity carried in the second data response instruction is the identity of the previous source driver chip, a third data response instruction is sent to the timing controller and the remaining source driver chips via the first signal line, wherein the third data response instruction includes the identity of the source driver chip and data of the source driver chip.

Optionally, the start source driver chip is the first source driver chip of the plurality of source driver chips which are arranged according to the response feedback sequence.

Figure 10:
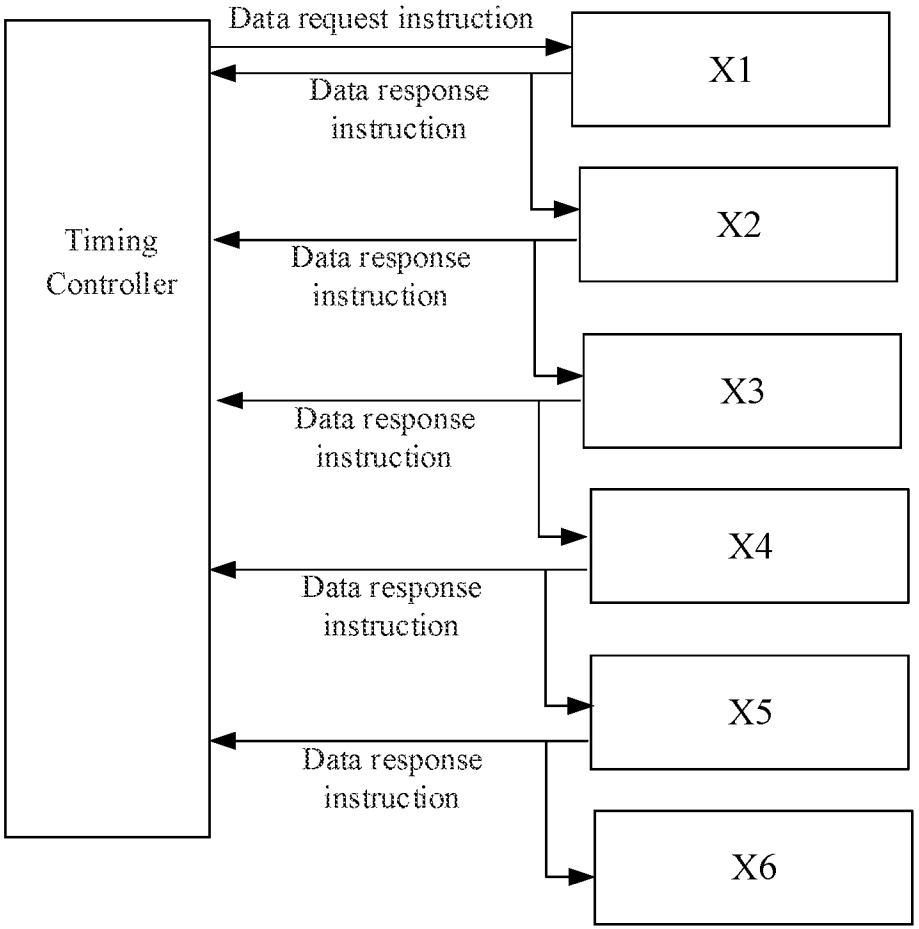
FIG. 10 is a schematic structural diagram of a data transmission system according to an illustrative embodiment of the present application.

For example, referring to FIG. 10, it is assumed that there are six source driver chips: X1, X2, X3, X4, X5, and X6 in total, the identity of X1 is 1, the identity of X2 is 2, the identity of X3 is 3, the identity of X4 is 4, the identity of X5 is 5, and the identity of X6 is 6, so the response feedback sequence may be in the sequence of the six identities from small to large. X1 has the smallest identity, and X6 has the largest identity, so the sequence X1, X2, X3, X4, X5, and X6 after sequencing can be obtained. The start source driver chip is X1.

Referring to FIG. 10, the timing controller is used to generate the data request instruction and send the data request instruction via the first signal line, and the data request instruction includes the identity 1 of X1.

X1 is the start source driver chip, and X1 is used to send the data response instruction to the timing controller and the remaining source driver chips via the first signal line when receiving the data request instruction sent by the timing controller. The data response instruction includes the identity of X1 and the data of X1. X2, X3, X4, X5, and X6 are used to detect whether the identity carried in the data response instruction is the identity of the previous source driver chip when the data response instruction sent by X1 is received. Since X2 detects that the identity carried in the data response instruction is the identity of the previous source driver chip, X2 sends the data response instruction to the timing controller and the remaining source driver chips via the first signal line. The data response instruction includes the identity of X2 and the data of X2. X3, X4, X5 and X6 are used to detect whether the identity carried in the data response instruction is the identity of the previous source driver chip when the data response instruction sent by X2 is received. X3 detects that the identity carried in the data response instruction is the identity of the previous source driver chip, so that X3 sends the data response instruction to the timing controller and the remaining source driver chips via the first signal line. The data response instruction includes the identity of X3 and the data of X3. Similarly, X4, X5, and X6 also sequentially send the data response instructions to the timing controller and the remaining source driver chips via the first signal line, the data response instructions include the identities of the corresponding source driver chips and the data of the corresponding source driver chips. As a result, the timing controller sequentially receives the data response instructions sent by X1, X3, X4, X5, and X6 via the first signal line.

It should be additionally noted that in FIG. 10, when a certain source driver chip sends the data response instruction via the first signal line, the remaining source driver chips all receive the data response instruction. FIG. 10 only schematically shows a schematic diagram that the next source driver chip of such source driver chip receives the data response instruction and detects the identity carried in the data response instruction.

In summary, according to the data transmission system provided by the embodiment of the present application, the timing controller generates the data request instruction, and sends the data request instruction via the first signal line. The data request instruction includes the identity of the start source driver chip. The start source driver chip is different from the last source driver chip of the plurality of source driver chips, and the start source driver chip sends the first data response instruction to the timing controller and the remaining source driver chips via the first signal line when receiving the data request instruction. Each of the driver chips behind the start source driver chip sends the third data response instruction to the timing controller and the remaining source driver chips via the first signal line when receiving the second data response instruction sent by another source driver chip via the first signal line, and after detecting that the identity carried in the second data response instruction is the identity of the previous source driver chip. Compared with the related art, the timing controller can obtain the data of the source driver chips via the first signal line, and realize the data reading of the plurality of source driver chips at one step, thereby enriching the function of the first signal line, and improving the utilization rate of the first signal line. A variety of functions can be realized, and the system can be applied to the scenario where the source driver chips are required to return the data to the timing controller in real time.

Figure 11:
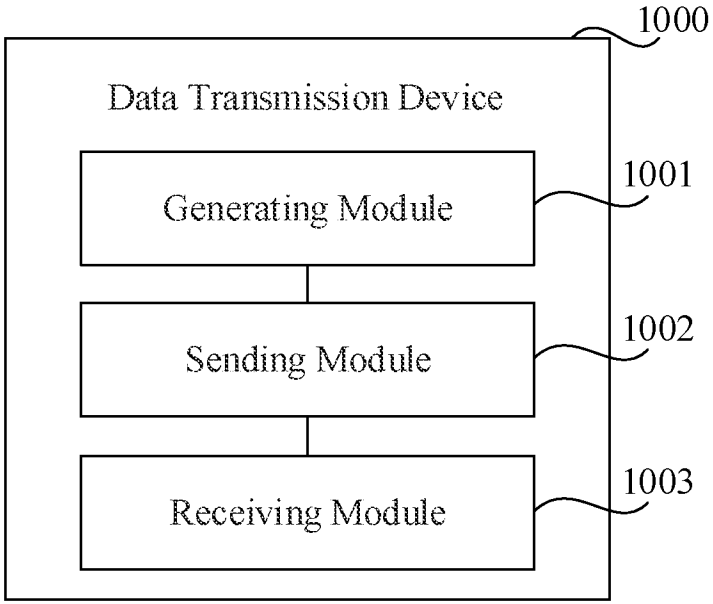
FIG. 11 is a schematic structural diagram of a data transmission device according to an embodiment of the present application.

The embodiment of the present application provides a data transmission device, which is applied to a controller. Referring to FIG. 1, the controller is connected to a plurality of driver chips connected in parallel via the first signal line, and the plurality of driver chips is sequenced according to a response feedback sequence. As shown in FIG. 11, the data transmission device 1000 includes the following modules.

A generating module 1001 is used to generate a data request instruction.

Optionally, the data request instruction includes the identity of a start driver chip and the start driver chip is a driver chip of the plurality of driver chips.

A sending module 1002 is used to send the data request instruction to the plurality of driver chips via the first signal line.

A receiving module 1003 is used to receive, via the first signal line, data response instructions sequentially sent by the plurality of driver chips according to the response feedback sequence. Each data response instruction includes the identity of the corresponding driver chip and the data of the corresponding driver chip.

Optionally, when the data request instruction comprises an identity of the start driver chip, the generating module 1001 is used to receive, via the first signal line, data response instructions sequentially sent by the plurality of driver chips from the start driver chip according to the response feedback sequence, and the response feedback sequence is the sequence according to which the plurality of driver chips are arranged.

According to the data transmission device provided by the embodiment of the present application, the generating module generates the data request instruction, and the sending module sends the data request instruction via the first signal line. Afterwards, the receiving module receives the data response instructions sequentially sent by the plurality of driver chips from the start driver chip according to the response feedback sequence via the first signal line. Compared with the related art, the controller can obtain the data of the driver chip via the first signal line, thereby enriching the function of the first signal line and improving the utilization rate of the first signal line.

Optionally, each of the instructions transmitted on the first signal line includes a preamble, a start identification, data bits, and a stop identification that are sequentially arranged.

The preamble is used to instruct a recipient device to perform clock calibration and phase calibration, the start identification is used to indicate the start of data transmission, the data bits are used to carry the target data, and the stop identification is used to indicate the stop of the data transmission.

The target data carried by the data bits of the data request instruction includes: a transmission mode of the first signal line, an identity of the start driver chip, a register address configured on the plurality of driver chips, and a data checksum. The transmission mode of the first signal line is a bust read mode.

The target data carried by the data bits of each data response instruction includes: a transmission mode of the first signal line, an identity of the corresponding driver chip, a register address configured on the plurality of driver chips, data of a corresponding driver chip, and a data checksum. The transmission mode of the first signal line is a reply transmission mode.

Optionally, the time intervals between two adjacent instructions transmitted on the first signal line are equal to a preset duration.

Optionally, the start driver chip is different from the last one of the plurality of driver chips, and the receiving module 1003 is specifically used to receive, via the first signal line, the data response instructions sequentially sent by the plurality of driver chips from the start driver chip to the last driver chip according to the response feedback sequence.

Further, the data request instruction may further include: the identity of a termination driver chip, and the termination driver chip is a driver chip located behind the start driver chip in the plurality of driver chips. Correspondingly, the receiving module 1003 is specifically used to:

receive, via the first signal line, the data response instructions sequentially sent by the plurality of driver chips from the start driver chip to the termination driver chip according to the response feedback sequence.

Optionally, the start driver chip is the first driver chip obtained by sequencing the plurality of driver chips according to the response feedback sequence.

Optionally, the identities of the plurality of driver chips are characters having sequential features, and the response feedback sequence is a sequence obtained by sequencing according to the sequential features of the identities.

Optionally, the identities of the plurality of driver chips are different numbers, and the response feedback sequence is a sequence in which the identities are arranged from small to large.

Optionally, the preamble is obtained by Manchester encoding of continuous at least 8 bits of binary 0; the start identification includes continuous at least 2 bits of binary 0; the target data carried by the data bits is data obtained by Manchester encoding; and the stop identification includes continuous at least 2 bits of binary 1.

Figure 12:
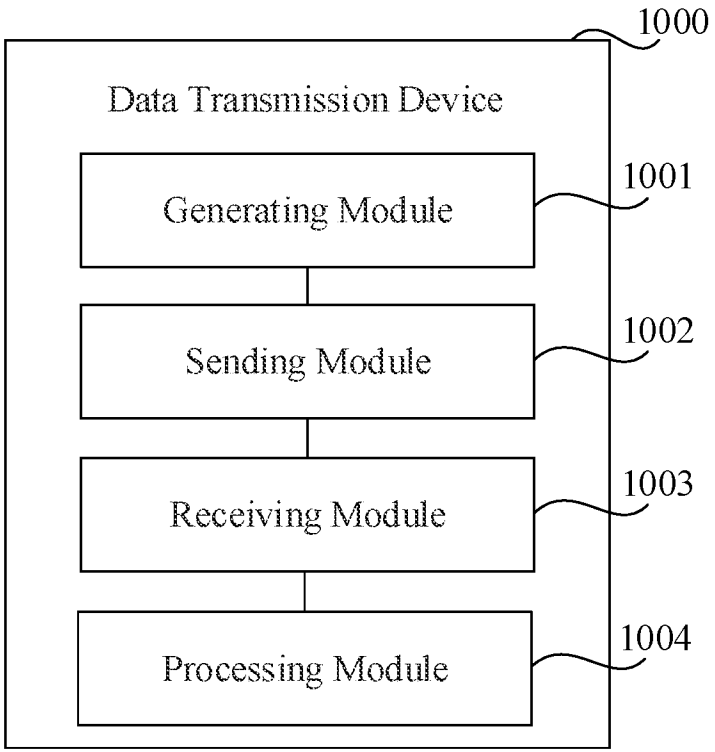
FIG. 12 is a schematic structural diagram of another data transmission device according to an embodiment of the present application.

FIG. 12 is a schematic structural diagram of another data transmission device provided on the basis of FIG. 11 according to an embodiment of the present application. Further, as shown in FIG. 12, the data transmission device 1000 may further include the following module.

A processing module 1004 is used to perform clock calibration operation when detecting that the signal on the first signal line is pulled low in the process of signal transmission via the first signal line.

In summary, according to the data transmission device provided by the embodiment of the present application, the generating module generates the data request instruction, and the sending module sends the data request instruction via the first signal line. Then the receiving module receives the data response instructions sequentially sent by the plurality of driver chips from the start driver chip according to the response feedback sequence via the first signal line. Compared with the related art, the controller can obtain the data of the driver chips via the first signal line, thereby enriching the function of the first signal line and improving the utilization rate of the first signal line.

Figure 13:
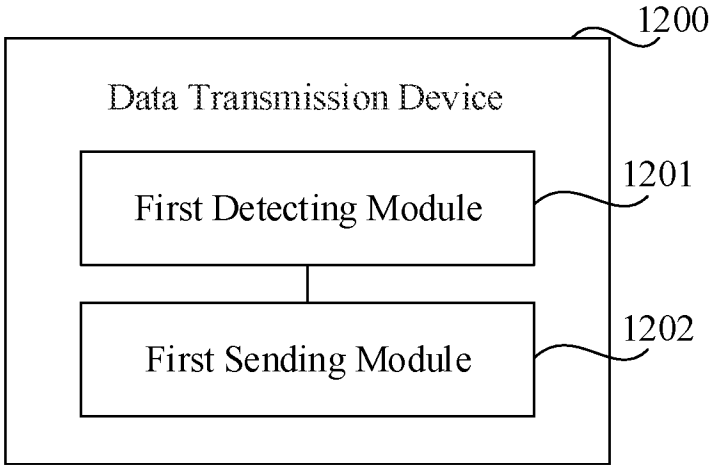
FIG. 13 is a schematic structural diagram of yet another data transmission device according to an embodiment of the present application.

The embodiment of the present application provides another data transmission device, which is applied to a first driver chip. Referring to FIG. 1, the first driver chip is any one of a plurality of driver chips, and the plurality of driver chips is connected in parallel, and connected to the controller via the first signal line. The plurality of driver chips is sequenced according to a response feedback sequence. As shown in FIG. 13, the data transmission device 1200 includes the following modules.

A first detecting module 1201 is used to: when receiving a data request instruction sent by the controller via the first signal line, detect whether the identity of the start driver chip carried in the data request instruction is the identity of the first driver chip.

A first sending module 1202 is used to: after detecting that the identity of the start driver chip is the identity of the first driver chip, send the first data response instruction to the controller and the remaining driver chips via the first signal line, and the first data response instruction includes the identity of the first driver chip and the data of the first driver chip.

The first data response instruction is used to trigger the plurality of driver chips to sequentially send the data response instructions from the first driver chip behind the first driver chip according to the response feedback sequence. Each of the data response instructions includes the identity of the corresponding driver chip and the data of the corresponding driver chip.

According to the data transmission device provided by the embodiment of the present application, after detecting that the identity of the start driver chip carried in the data request instruction is the identity of the first driver chip, the first sending module can send the first data response instruction to the controller and the remaining driver chips via the first signal line. The first data response instruction includes the identity of the first driver chip and the data of the first driver chip. Compared with the related art, the driver chips can send the data to the controller via the first signal line, so the function of the first signal line is enriched, and the utilization rate of the first signal line is improved.

Optionally, each of the instruction transmitted on the first signal line includes a preamble, a start identification, data bits, and a stop identification that are sequentially arranged.

The preamble is used to instruct the recipient device to perform clock calibration and phase calibration, the start identification is used to indicate the start of data transmission, the data bits are used to carry the target data, and the stop identification is used to indicate the stop of the data transmission.

Optionally, the target data carried by the data bits of the data request instruction includes: a transmission mode of the first signal line, an identity of the start driver chip, a register address configured on the plurality of driver chips, and a data checksum. The transmission mode of the first signal line is a bust read mode.

The target data carried by the data bits of each data response instruction includes: a transmission mode of the first signal line, an identity of the corresponding driver chip, a register address configured on the plurality of driver chips, the data of a corresponding driver chip, as well as a data checksum. The transmission mode of the first signal line is a reply transmission mode.

Optionally, the time intervals between two adjacent instructions transmitted on the first signal line are equal to a preset duration.

Figure 14:
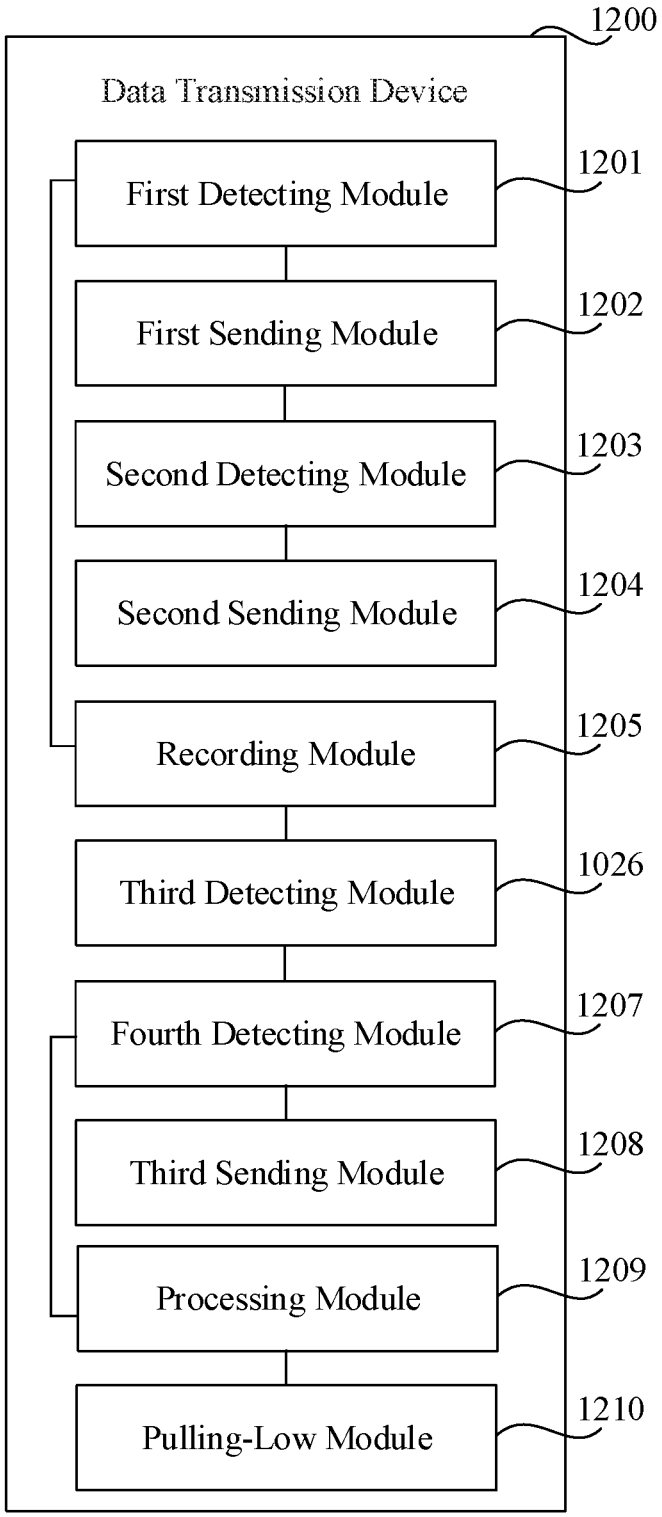
FIG. 14 is a schematic structural diagram of still a further data transmission device according to an embodiment of the present application.

Optionally, the start driver chip is different from the last one of the plurality of driver chips. FIG. 14 is a schematic structural diagram of another data transmission device provided on the basis of FIG. 13 according to the embodiment of the present application. Further, as shown in FIG. 14, the data transmission device 1200 may further include the following modules.

A second detecting module 1203 is used to: when receiving the second data response sent by another driver chip via the first signal line after detecting that the identity of the start driver chip is not the identity of the first driver chip, detect whether the identity carried in the second data response instruction is the identity of the previous driver chip of the first driver chip.

A second sending module 1204 is used to: after detecting that the identity carried in the second data response instruction is the identity of the previous driver chip, send a third data response instruction to the controller and the remaining driver chips via the first signal line, the third data response instruction including an identity of the first driver chip and data of the first driver chip.

The third data response instruction is used to trigger the plurality of driver chips to sequentially send the data response instructions from the first driver chip behind the first driver chip according to the response feedback sequence. Each of the data response instructions includes the identity of the corresponding driver chip and the data of the corresponding driver chip.

Further, the data request instruction may further include the identity of a termination driver chip, and the termination driver chip is a driver chip located behind the start driver chip in the plurality of driver chips, as shown in FIG. 14. The data transmission device 1200 may further include the following modules.

A recording module 1205 is used to record the identity of the termination driver chip after detecting that the identity of the start driver chip is not the identity of the first driver chip.

A third detecting module 1026 is used to: when receiving the second data response instruction sent by another driver chip via the first signal line, detect whether the identity carried in the second data response instruction is the identity of the previous driver chip of the first driver chip.

A fourth detecting module 1207 is used to: after detecting that the identity carried in the second data response instruction is the identity of the previous driver chip, detect whether the identity of the previous driver chip is the identity of the termination driver chip.

A third sending module 1208 is used to: when the identity of the current driver chip is not the identity of the termination driver chip, send a third data response instruction to the controller and the remaining driver chips via the first signal line, the third data response instruction including the identity of the first driver chip and the data of the first driver chip.

A processing module 1209 is used to stop action when the identity of the current driver chip is to the identity of the termination driver chip.

The third data response instruction is used to trigger the plurality of driver chips to sequentially send the data response instructions from the first driver chip behind the first driver chip according to the response feedback sequence. Each of the data response instructions includes the identity of the corresponding driver chip and the data of the corresponding driver chip.

Optionally, the start driver chip is the first driver chip obtained by sequencing the plurality of driver chips according to the response feedback sequence.

Optionally, the identities of the plurality of driver chips are characters having sequential features, and the response feedback sequence is a sequence obtained by sequencing according to the sequential features of the identities.

Optionally, the identities of the plurality of driver chips are different numbers, and the response feedback sequence is a sequence in which the identities are arranged from small to large.

Optionally, the preamble is obtained by Manchester encoding of continuous at least 8 bits of binary 0; the start identification includes continuous at least 2 bits of binary 0; the target data carried by the data bits is data obtained by Manchester encoding; and the stop identification includes continuous at least 2 bits of binary 1.

Further, as shown in FIG. 14, the data transmission device 1200 may further include the following module: A pulling-low module 1210, which is used to: when the first driver chip has an abnormality in the process of signal transmission via the first signal line, pull the signal on the first signal line low, so that the controller performs clock calibration operation according to the pulled-low signal.

In summary, according to the data transmission device provided by the embodiment of the present application, after the first sending module detects that the identity of the start driver chip carried in the data request instruction is the identity of the first driver chip, the first sending module can send the first data response instruction to the controller and the remaining driver chips via the first signal line. The first data response instruction includes the identity of the first driver chip and the data of the first driver chip. Compared with the related art, the driver chips can send the data to the controller via the first signal line, thus enriching the function of the first signal line and improving the utilization rate of the first signal line.

Those skilled in the art can clearly understand that for the convenience and brevity of description, the specific working process of the foregoing devices and modules can refer to the corresponding processes in the foregoing method embodiments, and details are not repeated herein.

The embodiment of the present application provides a display device, including a controller and a plurality of driver chips. The plurality of driver chips includes the above first driver chip. The connection manner between the controller and each driver chip can refer to above FIG. 1. The controller includes the data transmission device shown in FIG. 11 or FIG. 12. The plurality of drive chips includes the data transmission device shown in FIG. 13 or FIG. 14.

For example, the display device may be any product or component having a display function, such as a liquid crystal panel, electronic paper, an OLED panel, a mobile phone, a tablet computer, a television, a display, a notebook computer, a digital photo frame and a navigator.

Figure 15:
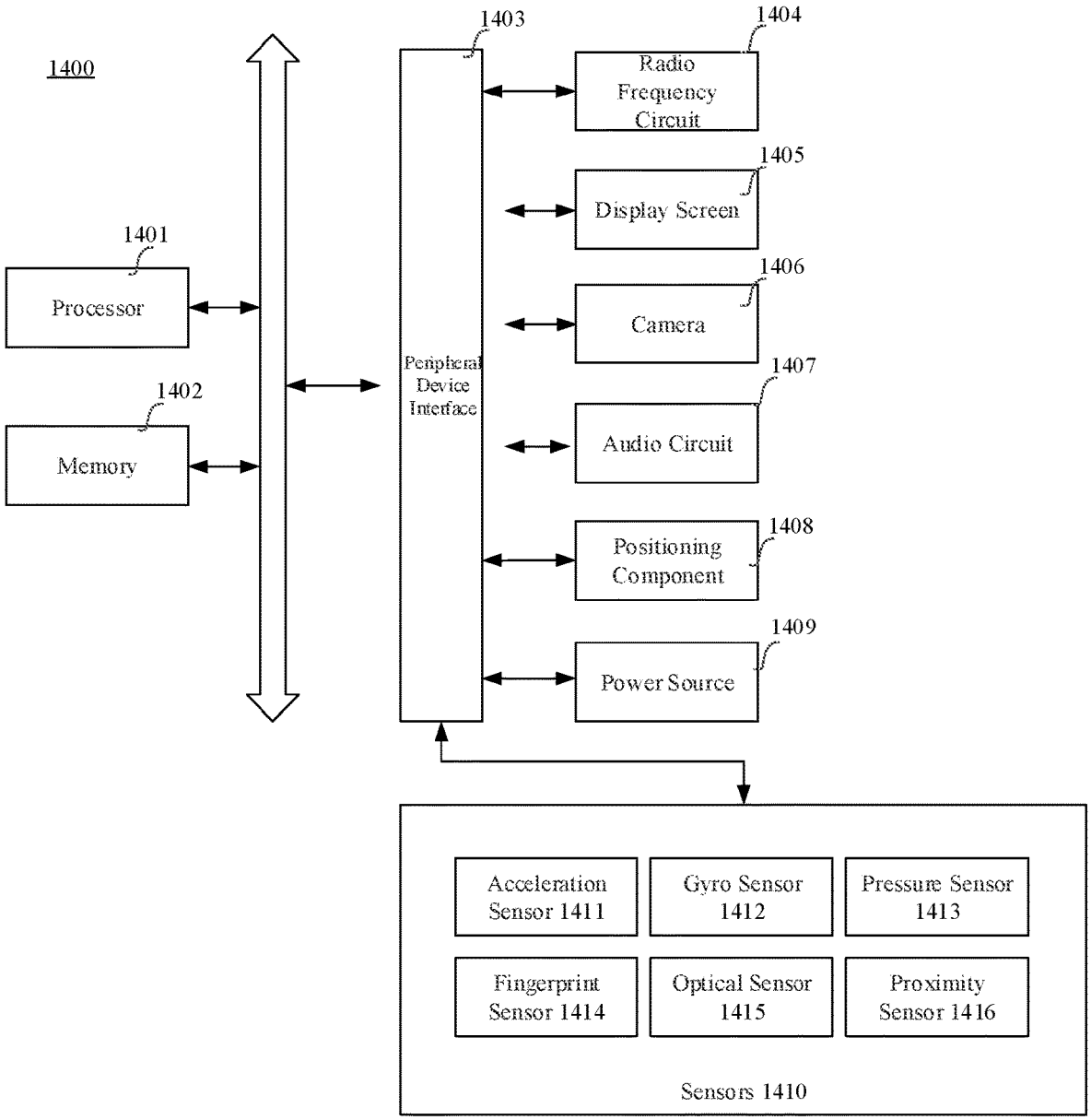
FIG. 15 is a structural block diagram of another display device according to an embodiment of the present application.

FIG. 15 is a structural block diagram of a display device 1400 provided by an exemplary embodiment of the present application. The device 1400 may be any product or component having a display function, such as a liquid crystal panel, electronic paper, an OLED panel, a mobile phone, a tablet computer, a television, a display, a notebook computer, a digital photo frame and a navigator. Generally, the device 1400 includes a processor 1401 and a memory 1402.

The processor 1401 may include one or more processing cores, such as a 4-core processor and an 8-core processor. The processor 1401 may be implemented by at least one of hardware forms of a DSP (Digital Signal Processing), an FPGA (Field-Programmable Gate Array), and a PLA (Programmable Logic Array). The processor 1401 may also include a main processor and a coprocessor. The main processor is a processor for processing data in an awaken state, and is also called as CPU (Central Processing Unit). The coprocessor is a low-power consumption processor for processing data in a standby state. In some embodiments, the processor 1401 may be integrated with a GPU (Graphics Processing Unit), which is responsible for rendering and drawing of content that needs to be displayed on a display screen. In some embodiments, the processor 1401 may further include an AI (Artificial Intelligence) processor, used to process computational operations related to machine learning.

The memory 1402 can include one or more computer readable storage mediums, which can be non-transitory. The memory 1402 may also include a high-speed random access memory, and a non-volatile memory such as one or more magnetic disk storage devices and flash memory storage devices. In some embodiments, the non-transitory computer readable storage medium in the memory 1402 is used to store at least one instruction. The at least one instruction is used to be executed by the processor 1401 to implement the data transmission method provided by the method embodiments of the present application.

In some embodiments, the device 1400 optionally further includes a peripheral device interface 1403 and at least one peripheral device. The processor 1401, the memory 1402, and the peripheral device interface 1403 may be connected by a bus or a signal line. Each peripheral device can be connected to the peripheral device interface 1403 by a bus, a signal line, or a circuit board. Specifically, the peripheral device includes at least one of a radio frequency circuit 1404, a display screen 1405, a camera 1406, an audio circuit 1407, a positioning component 1408, and a power source 1409.

The peripheral device interface 1403 can be used to connect at least one I/O (Input/Output)-associated peripheral device to the processor 1401 and the memory 1402. In some embodiments, the processor 1401, the memory 1402, and the peripheral interface 1403 are integrated on the same chip or circuit board. In some other embodiments, any one or two of the processor 1401, the memory 1402, and the peripheral interface 1403 can be implemented on a separate chip or circuit board, which is not limited in the present embodiment.

The radio frequency circuit 1404 is used to receive and transmit an RF (Radio Frequency) signal, also referred to as an electromagnetic signal. The radio frequency circuit 1404 communicates with the communication network and other communication devices via the electromagnetic signal. The radio frequency circuit 1404 converts the electrical signal into the electromagnetic signal for sending, or converts the received electromagnetic signal into the electrical signal. Optionally, the radio frequency circuit 1404 includes an antenna system, an RF transceiver, one or more amplifiers, a tuner, an oscillator, a digital signal processor, a coding and decoding chipset, a subscriber identity module card, and the like. The radio frequency circuit 1404 can communicate with other devices via at least one wireless communication protocol. The wireless communication protocol includes, but not limited to, a metropolitan area network, various generations of mobile communication networks (2G, 3G, 4G, and 5G), a wireless local area network, and/or a WiFi (Wireless Fidelity) network. In some embodiments, the radio frequency circuit 1404 may also include an NFC (Near Field Communication)-related circuit, which is not limited in the present application.

The display screen 1405 is used to display a UI (User Interface). The UI can include graphics, texts, icons, videos, and any combination thereof. When the display screen 1405 is a touch display screen, the display screen 1405 also has the capability of capturing a touch signal on the surface or over the surface of the display screen 1405. The touch signal may be input to the processor 1401 as a control signal for processing. At this point, the display screen 1405 may also be used to provide virtual buttons and/or a virtual keyboard, which are also referred to as soft buttons and/or soft keyboard. In some embodiments, one display screen 1405 is disposed, and disposed at the front panel of the device 1400. In other embodiments, at least two display screens 1405 are disposed, and are respectively disposed on different surfaces of the device 1400 or in a folded design. In still other embodiments, the display screen 1405 may be a flexible display screen disposed on a curved surface or folded surface of the device 1400. The display screen 1405 may even be set to a non-rectangular irregular pattern, that is, irregular screen. The display screen 1405 may include an LCD display panel or an OLED display panel.

The camera component 1406 is used to capture images or videos. Optionally, the camera component 1406 includes a front camera and a rear camera. Typically, the front camera is placed on the front panel of the device and the rear camera is placed on the back surface of the device. In some embodiments, at least two rear cameras are disposed and are respectively any one type of a main camera, a depth camera, a wide-angle camera, and a telephoto camera, so as to realize the background blur function realized by fusion of the main camera and the depth camera, the panoramic shooting and VR (Virtual Reality) shooting realized by fusion of the main camera and the wide-angle camera, or other fused shooting functions. In some embodiments, the camera component 1406 may also include a flash. The flash may be a monochrome temperature flash or a two-color temperature flash. The two-color temperature flash is a combination of a warm flash and a cool flash and can be used for light compensation at different color temperatures.

The audio circuit 1407 may include a microphone and a loudspeaker. The microphone is used to collect sound waves of the user and the environment, and convert the sound waves into electrical signals for being input to the processor 1401 for processing, or being input to the radio frequency circuit 1404 for voice communication. For the purpose of stereo acquisition or noise reduction, multiple microphones may be disposed, and are respectively disposed at different portions of the device 1400. The microphone may also be an array microphone or an omnidirectional acquisition microphone. The loudspeaker is then used to convert the electrical signals from the processor 1401 or the radio frequency circuit 1404 into the sound waves. The loudspeaker may be a conventional film loudspeaker or a piezoelectric ceramic loudspeaker. When the loudspeaker is the piezoelectric ceramic loudspeaker, not only can the electrical signals be converted into the sound waves audible to humans, but also the electrical signals can be converted into the sound waves inaudible to humans for the purpose such as ranging. In some embodiments, the audio circuit 1407 may also include a headphone jack.

The positioning component 1408 is used to position the current geographic location of the device 1400 to implement navigation or LBS (Location Based Service). The positioning component 1408 may be a positioning component based on the GPS (Global Positioning System) of the United States, the Beidou system of China, or the Greiner system of Russia or the Galileo system of the European Union.

The power source 1409 is used to supply power for various components in the device 1400. The power source 1409 can be alternating current, direct current, a disposable battery, or a rechargeable battery. When the power source 1409 includes the rechargeable battery, the rechargeable battery may support wired charging or wireless charging. The rechargeable battery may also be used to support the fast charging technology.

In some embodiments, the device 1400 also includes one or more sensors 1410. The one or more sensors 1410 include, but not limited to, an acceleration sensor 1411, a gyro sensor 1412, a pressure sensor 1413, a fingerprint sensor 1414, an optical sensor 1415, and a proximity sensor 1416.

The acceleration sensor 1411 may detect the size of the acceleration on the three coordinate axes of a coordinate system established by the device 1400. For example, the acceleration sensor 1411 can be used to detect the components of gravity acceleration on the three coordinate axes. The processor 1401 may control the touch display screen 1405 to display a user interface in a landscape view or a portrait view according to the gravity acceleration signal collected by the acceleration sensor 1411. The acceleration sensor 1411 may also be used for collecting game or user motion data.

The gyro sensor 1412 may detect the body direction and the rotation angle of the device 1400, and the gyro sensor 1412 may cooperate with the acceleration sensor 1411 to collect the 3D motion of the user on the device 1400 synergistically. According to the data collected by the gyro sensor 1412, the processor 1401 can implement the following functions of motion sensing (for example, changing the UI according to the tilting operation of the user), image stabilization at the time of shooting, game control, and inertial navigation.

The pressure sensor 1413 may be disposed on a side frame of the device 1400 and/or a lower layer of the touch display screen 1405. When the pressure sensor 1413 is disposed on the side frame of the device 1400, the holding signal of the user for the device 1400 can be detected, and the processor 1401 performs left and right-hand recognition or shortcut operation according to the holding signal collected by the pressure sensor 1413. When the pressure sensor 1413 is disposed on the lower layer of the touch display screen 1405, the processor 1401 controls an operability control on the UI interface according to the pressure operation of the user on the touch display screen 1405. The operability control includes at least one of a button control, a scroll bar control, an icon control, and a menu control.

The fingerprint sensor 1414 is used to collect the fingerprint of the user, and the processor 1401 identifies the identity of the user according to the fingerprint collected by the fingerprint sensor 1414, or the fingerprint sensor 1414 identifies the identity of the user according to the collected fingerprint. When identifying that the identity of the user is a trusted identity, the processor 1401 authorizes the user to perform related sensitive operations, including unlocking the screen, viewing encrypted information, downloading software, paying and changing settings, and the like. The fingerprint sensor 1414 may be placed on the front, back or side surface of the device 1400. When the device 1400 is provided with a physical button or manufacturer logo, the fingerprint sensor 1414 can be integrated with a physical button or vendor logo.

The optical sensor 1415 is used to collect ambient light intensity. In one embodiment, the processor 1401 may control the display brightness of the touch display screen 1405 based on the ambient light intensity collected by the optical sensor 1415. Specifically, when the ambient light intensity is relatively high, the display brightness of the touch display screen 1405 is raised. When the ambient light intensity is relatively low, the display brightness of the touch display screen 1405 is lowered. In another embodiment, the processor 1401 may also dynamically adjust the shooting parameters of the camera component 1406 based on the ambient light intensity collected by the optical sensor 1415.

The proximity sensor 1416, also referred to as a distance sensor, is typically disposed on the front panel of the device 1400. The proximity sensor 1416 is used to capture the distance between the user and the front surface of the device 1400. In one embodiment, when the proximity sensor 1416 detects that the distance between the user and the front surface of the device 1400 gradually decreases, the touch screen 1405 is controlled by the processor 1401 to switch from a bright screen state to a dark screen state. When the proximity sensor 1416 detects that the distance between the user and the front surface of the device 1400 gradually increases, the processor 1401 controls the touch display screen 1405 to switch from the dark screen state to the bright screen state.

It will be understood by those skilled in the art that the structure shown in FIG. 15 does not constitute a limitation on the device 1400, and may include more or less components than those illustrated, or combine some components or adopt different component arrangements.

The embodiment of the present application further provides a data transmission device, which is applied to a controller. The controller is connected to a plurality of driver chips connected in parallel connected in parallel via the first signal line, and the plurality of driver chips is sequenced according to a response feedback sequence. The data transmission device includes: one or more processors; and a memory.

The memory stores one or more programs. The one or more programs are used to be executed by the one or more processors. By configuration, the one or more processors perform the above programs to perform the data transmission method performed by the controller in the above embodiment.

The embodiment of the present application further provides a data transmission device, which is applied to a first driver chip. The first driver chip is any one of a plurality of driver chips. The plurality of driver chips is connected in parallel, and is connected to the controller via the first signal line. The plurality of driver chips is sequenced according to a response feedback sequence, and the data transmission device includes: one or more processors; and a memory.

The memory stores one or more programs, the one or more programs are used to be executed by the one or more processors. After configuration, the one or more processors perform the above programs to perform the data transmission method performed by the first driver chip in the above embodiment.

The embodiment of the present application provides a data transmission device, including a memory, a processor, and a computer program stored on the memory and operable on the processor. When executing the computer program, the processor implements the data transmission method shown in FIG. 3 or FIG. 5.

The embodiment of the present application provides a data transmission device, including a memory, a processor, and a computer program stored on the memory and operable on the processor. When executing the computer program, the processor implements the data transmission method shown in FIG. 4 or FIG. 5.

The embodiment of the present application provides a chip. The chip includes a programmable logic circuit and/or program instruction. The chip is used to implement the data transmission method shown in FIG. 3 or FIG. 5 when in operation.

The embodiment of the present application provides a chip. The chip includes a programmable logic circuit and/or program instruction. The chip is used to implement the data transmission method shown in FIG. 4 or FIG. 5 when in operation.

The embodiment of the present application provides a computer readable storage medium, which is a non-volatile readable storage medium and stores a computer program. When being executed by the processor, the data transmission method shown in FIG. 3 or FIG. 5 is implemented.

The embodiment of the present application provides another computer readable storage medium, which is a non-volatile readable storage medium and stores a computer program. When being executed by the processor, the data transmission method shown in FIG. 4 or FIG. 5 is implemented.

The embodiment of the present application also provides a computer program product including instructions. When the computer program product operates on a computer, the computer is caused to execute the data transmission method shown in FIG. 3 or FIG. 5.

The embodiment of the present application also provides a computer program product including instructions. When the computer program product operates on a computer, the computer is caused to execute the data transmission method shown in FIG. 4 or FIG. 5.

Other embodiments of the present application will be apparent to those skilled in the art from consideration of the specification and practice of the present application. This application is intended to cover any variations, uses, or adaptations of the present application following the general principles thereof and including common knowledge or commonly used technical measures which are not disclosed herein. The specification and embodiments are to be considered as exemplary only, with a true scope and conception of the present application is indicated by the following claims.

It will be appreciated that the present application is not limited to the exact construction that has been described above and illustrated in the accompanying drawings, and that various modifications and changes can be made without departing from the scope thereof. It is intended that the scope of the present application only be limited by the appended claims.

What is claimed is:

1. A data transmission method, applied to a controller, wherein the controller is connected to a plurality of driver chips connected in parallel via a first signal line, the plurality of driver chips is sequenced according to a response feedback sequence, and the method comprises:

generating a data request instruction, wherein the data request instruction comprises an identity of a start driver chip, and the start driver chip is a driver chip of the plurality of driver chips;

sending, via the first signal line, the data request instruction to a first driver chip, the first driver chip being one of the plurality of driver chips, wherein the data request instruction is configured to instruct the first driver chip to determine whether the identity of the start driver chip is an identity of the first driver chip;

receiving, via the first signal line, after determining that the identity of the start driver chip is the identity of the first driver chip, a first data response instruction sent by the first driver chip according to the data request instruction, wherein the first data response instruction is configured to instruct the first driver chip to send the first data response instruction to remaining driver chips via the first signal line, the first data response instruction comprising the identity of the first driver chip and data of the first driver chip;

receiving, via the first signal line, data response instructions sequentially sent by driver chips behind the first driver chip according to the response feedback sequence, wherein each of the data response instructions comprises an identity of a corresponding driver chip and data of the corresponding driver chip; and receiving, after the first driver chip determines that the identity of a driver chip carried in a second data response instruction is the identity of a previous driver chip of the first driver chip, a third data response instruction sent by the first driver chip via the first signal line, wherein the start driver chip is different from a last driver chip of the plurality of driver chips, wherein the second data response instruction is received by the first driver chip and sent by another driver chip via the first signal line, the third data response instruction is configured to be sent to remaining driver chips by the first driver chip via the first signal line, the third data response instruction comprises the identity of the first driver chip and the data of the first driver chip, the third data response instruction is configured to trigger driver chips behind the first driver chip in the plurality of driver chips to sequentially send data response instructions according to the response feedback sequence.

2. The method according to claim 1, wherein receiving, via the first signal line, the data response instructions sequentially sent by the plurality of driver chips from the driver chips behind the first driver chip according to the response feedback sequence comprises: receiving, via the first signal line, the data response instructions sequentially sent by the plurality of driver chips from the driver chips behind the first driver chip to the last driver chip according to the response feedback sequence.

3. The method according to claim 1, wherein the data request instruction further comprises identity of a termination driver chip, wherein the termination driver chip is driver chip behind the start driver chip in the plurality of driver chips, and receiving, via the first signal line, the data response instructions sequentially sent by the plurality of driver chips from the driver chips behind the first driver chip according to the response feedback sequence comprises: receiving, via the first signal line, the data response instructions sequentially sent by the plurality of driver chips from the start driver chips behind the first driver chip to the termination driver chip according to the response feedback sequence.

4. The method according to claim 1, wherein the identities of the plurality of driver chips are characters having sequential features, and the response feedback sequence is a sequence obtained by sequencing according to the sequential features of the identities.

5. The method according to claim 1, further comprising:

in a process of signal transmission via the first signal line, performing clock calibration operation when detecting that a signal on the first signal line is pulled low.

6. The method according to claim 1, wherein each of instructions transmitted on the first signal line comprises a preamble, a start identification, data bits and a stop identification which are arranged in sequence;

wherein the preamble is used to instruct a recipient device to perform clock calibration and phase calibration, the start identification is used to indicate a start of data transmission, the data bits are used to carry target data, and the stop identification is used to indicate a stop of data transmission.

7. The method according to claim 6, wherein the target data carried by the data bits of the data request instruction comprises: a transmission mode of the first signal line, an identity of a start driver chip, a register address configured on the plurality of driver chips, and a data checksum, and the target data carried by the data bits of each of the data response instructions comprises: a transmission mode of the first signal line, an identity of the corresponding driver chip, a register address configured on the plurality of driver chips, data of the corresponding driver chip, and a data checksum.

8. A data transmission device, applied to a controller, wherein the controller is connected to a plurality of driver chips connected in parallel via a first signal line, the plurality of driver chips is sequenced according to a response feedback sequence, and the data transmission device comprises:

one or more processors; and a memory;

wherein the memory stores one or more programs, and the one or more programs are used to be executed by the one or more processors to implement the data transmission method according to claim 1.

9. A display device, comprising a controller, wherein the controller comprises the data transmission device according to claim 8.

10. A data transmission method, applied to a first driver chip, wherein the first driver chip is any one of a plurality of driver chips, the plurality of driver chips is connected in parallel and is connected to a controller via a first signal line, the plurality of driver chips is sequenced according to a response feedback sequence, and the method comprises:

receiving a data request instruction sent by the controller the first signal line; and when the first driver chip is a start driver chip, sending, via the first signal line, a first data response instruction to the controller and remaining driver chips, wherein the first data response instruction comprises an identity of the first driver chip and data of the first driver chip, wherein the start driver chip is different from a last driver chip of the plurality of driver chips, and the method further comprises:

when the first driver chip is not the start driver chip, receiving a second data response instruction sent by another driver chip via the first signal line; and when the identity of a driver chip carried in the second data response instruction is the identity of a previous driver chip of the first driver chip, sending a third data response instruction to the controller and remaining driver chips via the first signal line, wherein the third data response instruction comprises the identity of the first driver chip and the data of the first driver chip;

wherein, the first data response instruction is used to trigger driver chips behind the first driver chip in the plurality of driver chips to sequentially send data response instructions according to the response feedback sequence, wherein each of the data response instructions comprises an identity of a corresponding driver chip and data of the corresponding driver chip; the third data response instruction is used to trigger driver chips behind the first driver chip in the plurality of driver chips to sequentially send data response instructions according to the response feedback sequence.

11. The method according to claim 10, wherein the data request instruction comprises an identity of a termination driver chip, wherein the termination driver chip is a driver chip behind the start driver chip in the plurality of driver chips, and the method further comprises:

when an identity of the start driver chip is not the identity of the first driver chip, recording the identity of the termination driver chip;

receiving a second data response instruction sent by another driver chip via the first signal line; and when an identity carried in the second data response instruction is an identity of a previous driver chip of the first driver chip, and the identity of the previous driver chip is the identity of the termination driver chip, stopping action.

12. The method according to claim 10, wherein the identities of the plurality of driver chips are characters having sequential features, and the response feedback sequence is a sequence obtained by sequencing according to the sequential features of the identities.

13. The method according to claim 10, further comprising:

in a process of signal transmission via the first signal line, when the first driver chip has an abnormality, pulling a signal on the first signal line low.

14. The method according to claim 10, wherein the data request instruction comprises an identity of the start driver chip, and after receiving the data request instruction sent by the controller via the first signal line, the method further comprises:

determining whether the first driver chip is the start driver chip according to the identity of the start driver chip and identity of the first driver chip.

15. The method according to claim 10, wherein each of instructions transmitted on the first signal line comprises a preamble, a start identification, data bits and a stop identification which are arranged in sequence;

wherein the preamble is used to instruct a recipient device to perform clock calibration and phase calibration, the start identification is used to indicate a start of data transmission, the data bits are used to carry target data, and the stop identification is used to indicate a stop of data transmission.

16. The method according to claim 15, wherein the target data carried by the data bits of the data request instruction comprises: a transmission mode of the first signal line, an identity of a start driver chip, a register address configured on the plurality of driver chips, and a data checksum, and the target data carried by the data bits of each of the data response instructions comprises: a transmission mode of the first signal line, an identity of the corresponding driver chip, a register address configured on the plurality of driver chips, data of the corresponding driver chip, and a data checksum.

17. A data transmission device, applied to a first driver chip, wherein the first driver chip is any one of a plurality of driver chips, the plurality of driver chips is connected in parallel and is connected to a controller via a first signal line, the plurality of driver chips is sequenced according to a response feedback sequence, and the data transmission device comprises:

one or more processors; and a memory;

wherein the memory stores one or more programs, and the one or more programs are used to be executed by the one or more processors to implement the data transmission method according to claim 10.

18. A display device, comprising a plurality of driver chips, wherein the plurality of driver chips comprises the data transmission device according to claim 17.

19. A data transmission system, comprising: a timing controller and a plurality of source driver chips connected in parallel, wherein the timing controller is connected to the plurality of source driver chips connected in parallel via a first signal line, the plurality of source driver chips is sequenced according to a response feedback sequence, the plurality of source driver chips comprises a start source driver chip, and the start source driver chip is different from a last source driver chip of the plurality of source driver chips;

the timing controller is used to generate a data request instruction and send the data request instruction via the first signal line;

the start source driver chip is used to send a first data response instruction to the timing controller and remaining source driver chips via the first signal line when the data request instruction is received, wherein the first data response instruction comprises the identity of the start source driver chip and data of the start source driver chip; and each of source driver chips behind the start source driver chip is used to receive a second data response instruction sent by another source driver chip via the first signal line; and when an identity carried in the second data response instruction is an identity of a previous source driver chip of the source driver chip, a third data response instruction is sent via the first signal line to the timing controller and remaining source driver chips, wherein the third data response instruction comprises an identity of the source driver chip and data of the source driver chip.

* * * * *